US011932463B2

(12) United States Patent
Epstein et al.

(10) Patent No.: US 11,932,463 B2
(45) Date of Patent: Mar. 19, 2024

(54) TWO-COMPARTMENT LEAK-PROOF CONTAINERS

(71) Applicants: Kari-Out LLC, White Plains, NY (US); Hefei Yuanchuan Package Technology Co., Ltd., Hefei (CN)

(72) Inventors: Paul Epstein, White Plains, NY (US); Zhen Zheng, Hefei (CN)

(73) Assignees: KARI-OUT LLC, Tarrytown, NY (US); HEFEI YUANCHUAN PACKAGE TECHNOLOGY CO., LTD., Hefei (CN)

( * ) Notice: Subject to any disclaimer, the term of this patent is extended or adjusted under 35 U.S.C. 154(b) by 228 days.

(21) Appl. No.: 17/160,266

(22) Filed: Jan. 27, 2021

(65) Prior Publication Data

US 2022/0153468 A1 May 19, 2022

Related U.S. Application Data

(63) Continuation-in-part of application No. 29/758,978, filed on Nov. 19, 2020, now Pat. No. Des. 955,225, (Continued)

(51) Int. Cl.

| | |
|---|---|
| ***B65D 5/20*** | (2006.01) |
| ***B65D 5/42*** | (2006.01) |
| *B65D 5/4805* | (2006.01) |

(52) U.S. Cl.

CPC ..... *B65D 5/2047* (2013.01); *B65D 5/4266* (2013.01); *B65D 5/48022* (2013.01)

(58) Field of Classification Search

CPC .. B65D 5/48022; B65D 5/6629; B65D 5/242; B65D 5/2047

(Continued)

(56) References Cited

U.S. PATENT DOCUMENTS

| | | |
|---|---|---|
| 3,876,132 A | 4/1975 | Kuchenbecker |
| 4,472,896 A | 9/1984 | Brauner |

(Continued)

OTHER PUBLICATIONS

International Search Report for PCT/US2019/052447 dated Oct. 30, 2019.

(Continued)

*Primary Examiner* — Nathan J Newhouse
*Assistant Examiner* — Phillip D Schmidt
(74) *Attorney, Agent, or Firm* — PABST PATENT GROUP LLP

(57) ABSTRACT

Blanks for forming two-compartment containers and the resulting containers are described herein. The container includes a tray and four closure flaps hingedly connected thereto. The closure flaps can be closed to enclose food or other substances therein, or opened to provide access to and removal of the tray contents. The tray is separated into two compartments by an interior partition. Generally, each compartment is liquid tight. Each compartment includes a bottom, three sidewalls, one partition wall, and four corners; each corner is adjacent to a folded gusset. Two opposing sidewalls are located on a first set of opposing sides of the bottom and a third sidewall and the partition wall are located on a second set of opposing dies of the bottom. Each folded gusset generally adheres to an adjacent sidewall. In at least one compartment, each opposing sidewall contains an extension portion that adheres to its adjacent opposing sidewall.

20 Claims, 19 Drawing Sheets

Related U.S. Application Data and a continuation-in-part of application No. 29/758,783, filed on Nov. 18, 2020.

(58) Field of Classification Search
USPC ..... 229/120.08, 120.16, 120.17
See application file for complete search history.

(56) References Cited

U.S. PATENT DOCUMENTS

| | | | | |
|---|---|---|---|---|
| 4,489,879 | A | 12/1984 | Mode | |
| 4,848,648 | A * | 7/1989 | Eisman | B65D 5/48 229/148 |
| 4,877,178 | A | 10/1989 | Eisman | |
| 4,905,889 | A | 3/1990 | Schuster | |
| 4,944,451 | A | 7/1990 | Forbes, Jr. | |
| 5,009,363 | A | 4/1991 | Zavatone | |
| D326,227 | S | 5/1992 | Forbes, Jr. | |
| 5,160,081 | A | 11/1992 | Beales | |
| D332,393 | S | 1/1993 | Boone | |
| 5,205,476 | A | 4/1993 | Sorenson | |
| 5,323,958 | A * | 6/1994 | Liu | B65D 5/48004 229/407 |
| 5,326,017 | A * | 7/1994 | Liu | B65D 5/48022 229/407 |
| 5,332,148 | A * | 7/1994 | Liu | B65D 5/2047 229/407 |
| D349,610 | S | 8/1994 | Scott, Jr. | |
| 5,388,758 | A | 2/1995 | Scovell | |
| 5,411,204 | A | 5/1995 | Demay | |
| 5,467,916 | A | 11/1995 | Beales | |
| 5,575,420 | A | 11/1996 | Whitnell | |
| 5,588,583 | A * | 12/1996 | Cargile, Jr. | B65D 5/48022 229/190 |
| 5,601,231 | A | 2/1997 | Cai | |
| 5,839,652 | A | 11/1998 | Ben-Haim | |
| 5,908,152 | A * | 6/1999 | Tullis | B65D 5/2047 229/148 |
| 6,471,121 | B1 * | 10/2002 | Nielsen | B65D 5/48022 229/120.16 |
| D519,366 | S | 4/2006 | Epstein | |
| D519,830 | S | 5/2006 | Yocum | |
| 7,293,695 | B2 | 11/2007 | Stier | |
| 7,673,747 | B2 | 3/2010 | Yoda | |
| 8,523,049 | B2 | 9/2013 | Fitzwater | |
| 8,672,215 | B2 | 3/2014 | Learn | |
| 8,733,626 | B2 | 5/2014 | Learn | |
| 8,820,617 | B2 | 9/2014 | Silverstein | |
| 8,844,718 | B2 | 9/2014 | Hall | |
| 9,522,772 | B2 | 12/2016 | Fu | |
| D777,029 | S | 1/2017 | Stratton | |
| 9,540,135 | B2 | 1/2017 | Robertson | |
| 9,908,690 | B2 | 3/2018 | Torben | |
| 10,017,290 | B2 * | 7/2018 | Faulkner | B65D 5/2057 |
| 10,266,304 | B2 | 4/2019 | Smith | |
| D876,951 | S | 3/2020 | Sill | |
| 10,829,262 | B2 | 11/2020 | Sill | |
| 10,913,566 | B2 | 2/2021 | Exner | |
| 2005/0051461 | A1 * | 3/2005 | Bryant | B65D 5/6626 206/769 |
| 2005/0199689 | A1 * | 9/2005 | Chang | B65D 5/48022 229/120.07 |
| 2005/0205570 | A1 | 9/2005 | Ramirez | |
| 2007/0267467 | A1 | 11/2007 | Burke | |
| 2011/0253587 | A1 | 10/2011 | Pinkstone | |
| 2012/0000972 | A1 | 1/2012 | Learn | |
| 2012/0037692 | A1 | 2/2012 | Fitzwater | |
| 2012/0125987 | A1 | 5/2012 | Hubbard, Jr. | |
| 2012/0138668 | A1 | 6/2012 | Zinck | |
| 2014/0263595 | A1 | 9/2014 | Pantelleria | |
| 2014/0353367 | A1 | 12/2014 | Fairchild, Jr. | |
| 2016/0362217 | A1 | 12/2016 | Hajek | |
| 2018/0251256 | A1 | 9/2018 | Baryshyan | |
| 2019/0047746 | A1 | 2/2019 | Kunishima | |
| 2021/0053718 | A1 | 2/2021 | Bautista Fernandez | |
| 2021/0284381 | A1 | 9/2021 | Valencia | |
| 2022/0106072 | A1 | 4/2022 | Hartinger Peña | |

OTHER PUBLICATIONS

Good Start Packaging: Fiber Compost-A-Pak from Mar. 24, 2016: http://web.archive.org/web/20160324111743/https:/www.goodstartpackaging.com/.

* cited by examiner

TWO-COMPARTMENT LEAK-PROOF CONTAINERS

CROSS-REFERENCE TO RELATED APPLICATIONS

This application claims priority to U.S. application Ser. No. 29/758,783, filed Nov. 18, 2020 and U.S. application Ser. No. 29/758,978, filed Nov. 19, 2020, the disclosures of which are incorporated herein by reference.

FIELD OF THE INVENTION

This invention generally relates to containers for storing and transporting food.

BACKGROUND OF THE INVENTION

The "take-out" food industry has expanded the variety of food for serving. Different types of food items in a single order are typically placed in separate containers. This requires the handling of multiple containers and increases cost. Various containers have been designed to include segregated compartments to store and transport multiple food items in a single order. However, many of these containers do not prevent or reduce leakage of fluids during travel, or are made from Styrofoam or other non-degradable materials.

There is a need for improved containers for storing and transporting multiple food items in separate compartments.

Particularly, there is a need for containers that are able to secure different food items inside separate compartments of the containers prior to use, which also prevent or reduce leakage of liquids or sauces that are placed in the containers.

There is also a need for improved food containers that are made from easily degraded or recycled materials, such as paperboard, which also store multiple food items in separate compartments, and prevent or reduce leakage of liquids or sauces that are stored in the containers.

SUMMARY OF THE INVENTION

Blanks for forming two-compartment containers and the resulting two-compartment containers are described herein. The two-compartment container is leak-resistant, and includes a tray and four closure flaps that are hingedly connected to the tray, such that the closure flaps can be closed over the tray to enclose food therein, or opened to allow access to and removal of food from inside the tray. Optionally, the closure flaps are attached to the tray by a perforated fold line and can be removed from the tray.

The tray contains a first compartment and a second compartment. The first compartment is separated from the second compartment by an interior partition. Each compartment is liquid tight.

Typically, each compartment has a substantially trapezoidal shape containing a bottom, three sidewalls, one partition wall, and four corners; each corner is adjacent to a folded gusset. Each corner is formed by folding the gusset panels in a set of gusset panels such that a first gusset panel, typically the larger gusset panel, covers a second gusset panel, typically the smaller gusset panel, and adhering the resulting folded gusset to an adjacent sidewall or partition wall in the compartment. Each of the sidewall and the partition wall is connected to one side of the bottom via a bottom edge.

In each compartment, two sidewalls are on a first set of opposite sides of the bottom ("opposing sidewalls") and a third sidewall and the partition wall are on a second set of opposite sides of the bottom. Each folded gusset contacts and adheres to the opposing sidewall or the third sidewall, optionally by thermal bonding.

Each opposing sidewall of the first or second compartment contains an extension portion. Typically, an exterior surface of each extension portion contacts and adheres to an extension contacting portion of an interior surface of the adjacent opposing sidewall, optionally by thermal bonding.

BRIEF DESCRIPTION OF THE DRAWINGS

Unless otherwise stated, within the borders of an illustration of a blank, dashed lines indicate fold lines or other lines of weakness and solid lines indicate borders flaps of the blank.

Unless otherwise stated, with respect to illustrations of the assembled container, solid lines indicate fold lines, score lines, perforation lines, or other lines of weakness.

FIG. 1A includes labels for the closure flaps and the tray portion (dashed lines indicate the fold lines and solid lines indicate the cut lines, which also apply to FIGS. 1B-1D). FIG. 1B includes labels for the cut-out portions (dash-dotted lines indicate the boundaries of the tray portion). FIG. 1C includes labels for the elements of the first tray portion (dash-dotted lines indicate the boundaries of the first tray portion). FIG. 1D includes labels for the elements of the second tray portion (dash-dotted lines indicate the boundaries of the second tray portion).

FIG. 2A includes labels for the closure flaps, the cut-out portions, and the tray portion. FIG. 2B includes labels for the elements of the first tray portion. FIG. 2C includes labels for the elements of the second tray portion.

FIG. 3A depicts the gusset panels in an open position. FIG. 3B depicts the gusset panels in a partially folded position. FIG. 3C depicts one set of gusset panels in a folded position and one set of gusset panels in a partially folded position. FIG. 3D depicts the gusset panels in a folded position. FIG. 3E includes labels for the length ($L_1$) of the extension portion and the length ($L_2$) of the corresponding opposing side tray panel.

FIG. 4 shows some of the gusset panels that form the folded gussets that contact and adhere to the interior surface of the opposing sidewall in each compartment of the two-compartment container.

FIG. 5A depicts a top isometric view of the container in an open position. FIG. 5B depicts a top view of the container in an open position. FIG. 5C depicts a top isometric view of the container in a closed and locked position.

FIG. 6A depicts a top isometric view of the container in an open position. FIG. 6B depicts a top view of the container in an open position. FIG. 6C depicts a top isometric view of the container in a closed and locked position. FIG. 6D depicts a rear view of the container and includes a label for the length ($L_t$) of the tray.

FIG. 9A includes labels for the elements for measuring the largest length ($L'_{1a}$) of the first extension portion and the largest length ($L'_{1b}$) of the second extension portion. FIG. 9B includes labels for the elements for measuring the total length ($L'_1$) of a set of extension portions and the length ($L'_2$) of the corresponding opposing side tray panel.

FIG. 10 shows some of the gusset panels that form the folded gussets and the extension portion that contact and adhere to the exterior surface of the opposing sidewall in each compartment of the two-compartment container.

DETAILED DESCRIPTION OF THE INVENTION

Paperboard blanks for forming clamshell containers and the resulting clamshell containers are described herein.

I. Assembled Two-Compartment Container

The two-compartment container contains a tray and four closure flaps. The closure flaps are hingedly connected to the tray such that the closure flaps can be closed over the tray to enclose food items therein, or opened or removed to allow access to and removal of food items from inside the tray.

The tray can have any suitable shape and dimensions, as long as it corresponds with the shape and dimension of the four closure flaps such that they are able to close and lock in the closed position.

A. Tray

The tray contains two compartments (referred to as the first and second compartment) separated by an interior partition, such that food items of different types can be placed into different compartments and remain in their respective compartment. The interior partition is formed by a pair of partition walls. Each compartment is generally leak-resistant, and prevents or reduces leakage of liquids out of the tray.

The first compartment may have the same shape as the second compartment or a shape that is different from the second compartment. The size of the first compartment may be the same as or different from the second compartment. For example, the first compartment has the same shape as the second compartment; the first compartment has the same size as the second compartment, or the first compartment is smaller or larger than the second compartment. For example, each of the first and second compartments has the shape of a trapezoidal prism, where the first compartment is smaller than the second compartment (see, e.g. FIG. 5A, first compartment 3200 and second compartment 3400). Optionally, each of the first and second compartments has the shape of a trapezoidal prism, and the first compartment has a size that is equal to or approximately equal to the second compartment. In such embodiments, the partition is located at or approximately at the center of the bottom of the tray (not shown in the Figures). For example, the partition 3310 shown in FIG. 5A would be located towards the center of the tray such that the first compartment 3200 has a size that is equal to or approximately equal to the size of the second compartment 3400.

Generally, each compartment has a substantially trapezoidal shape containing a bottom, three sidewalls, one partition wall, and four corners; each corner is located where a two sidewalls meet or where a sidewall meets the adjacent partition wall. Each corner is generally adjacent to a folded gusset. Each of the sidewalls and the partition wall is connected to one side of the bottom via a bottom edge. The bottom of each of the first compartment and the second compartment lies in the same plane, referred to herein as the bottom plane.

Figure 3A:
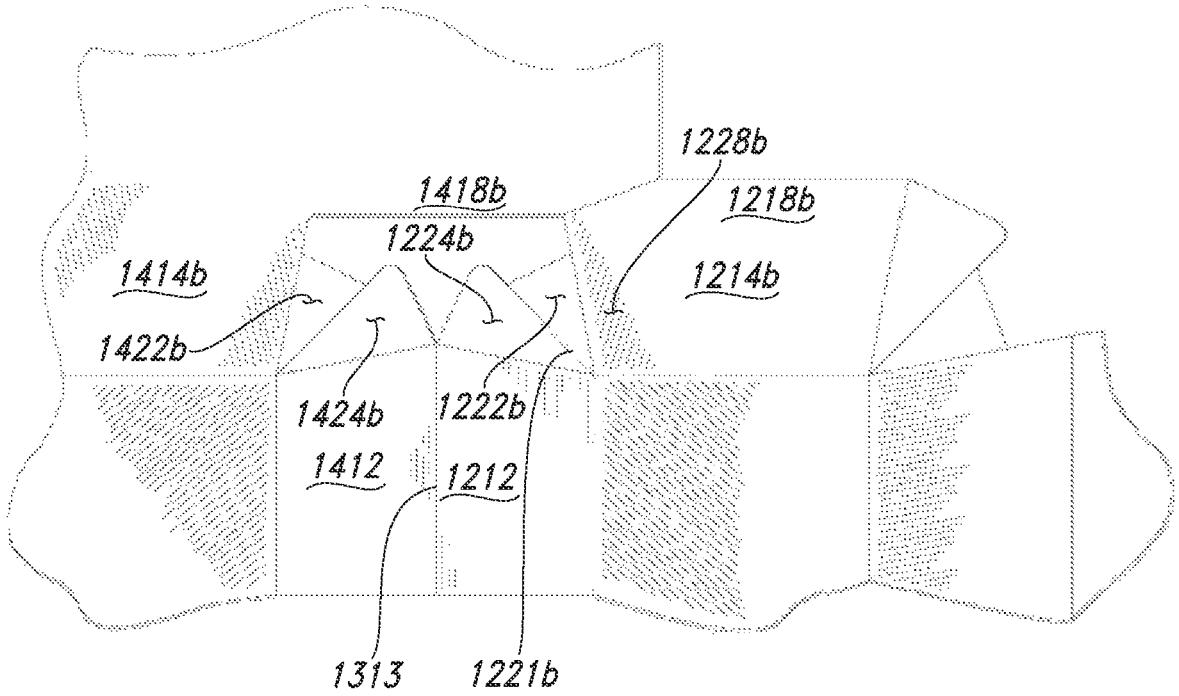
FIGS. 3A-3E are partial inside views of the gusset panels of the blank depicted in FIGS. 1A-1D that form the folded gusset in each compartment of the resulting two-compartment container.
Figure 3B:
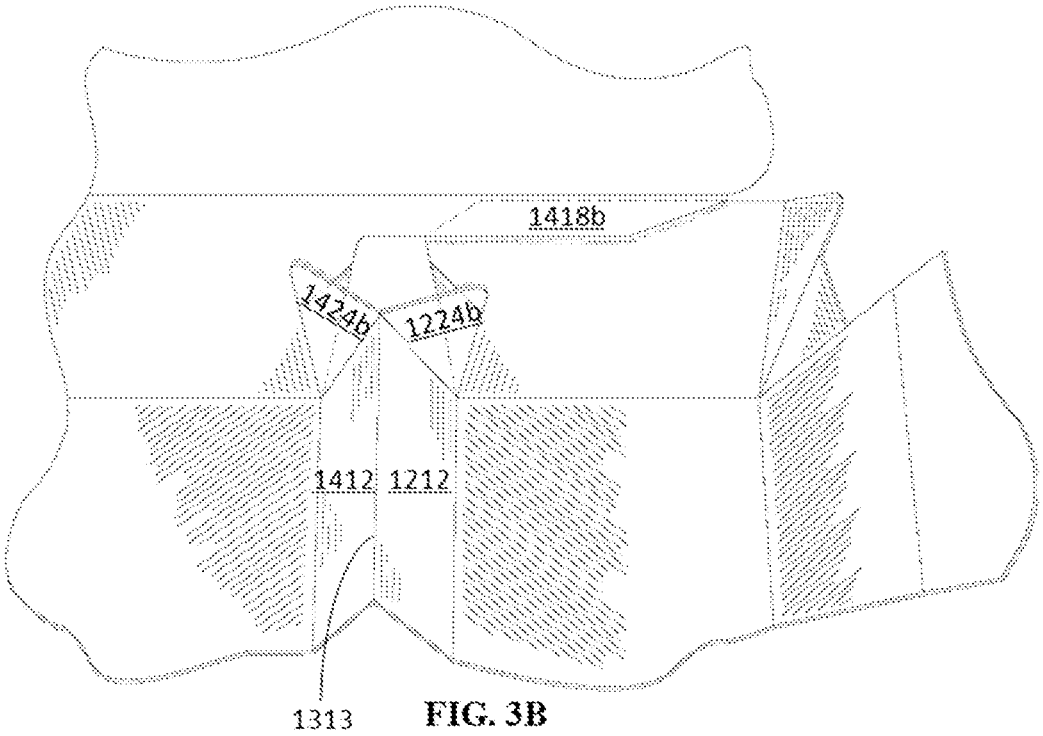
Figure 3C:
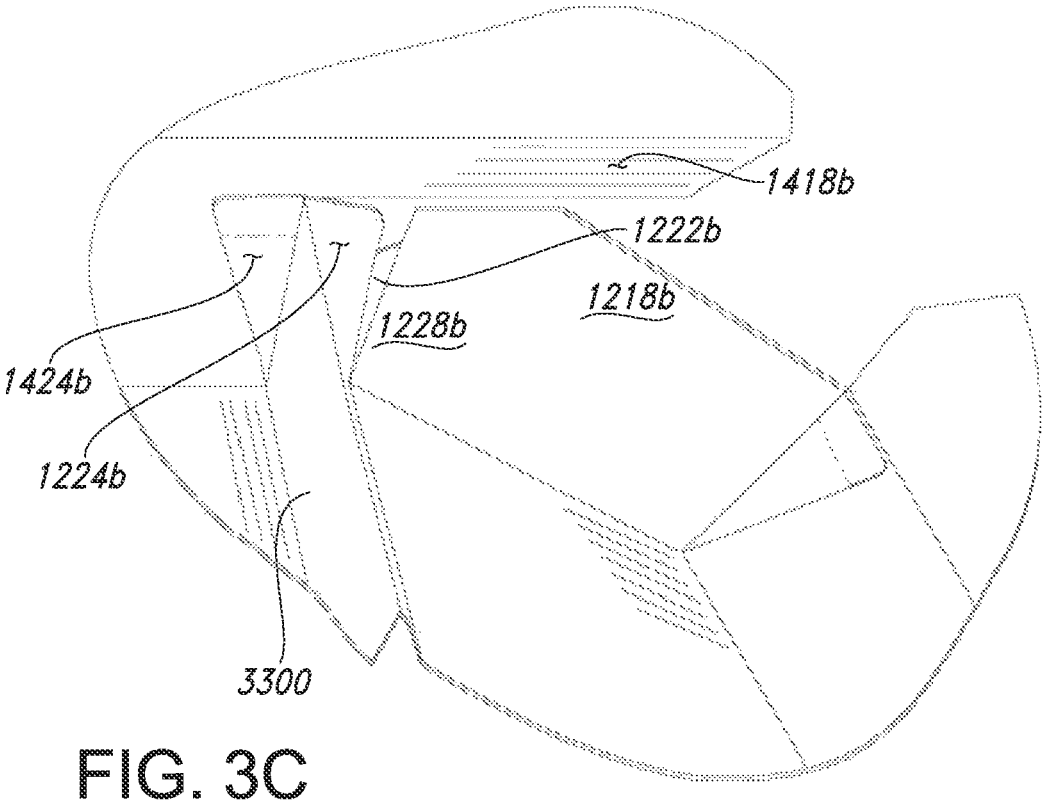
Figure 3D:
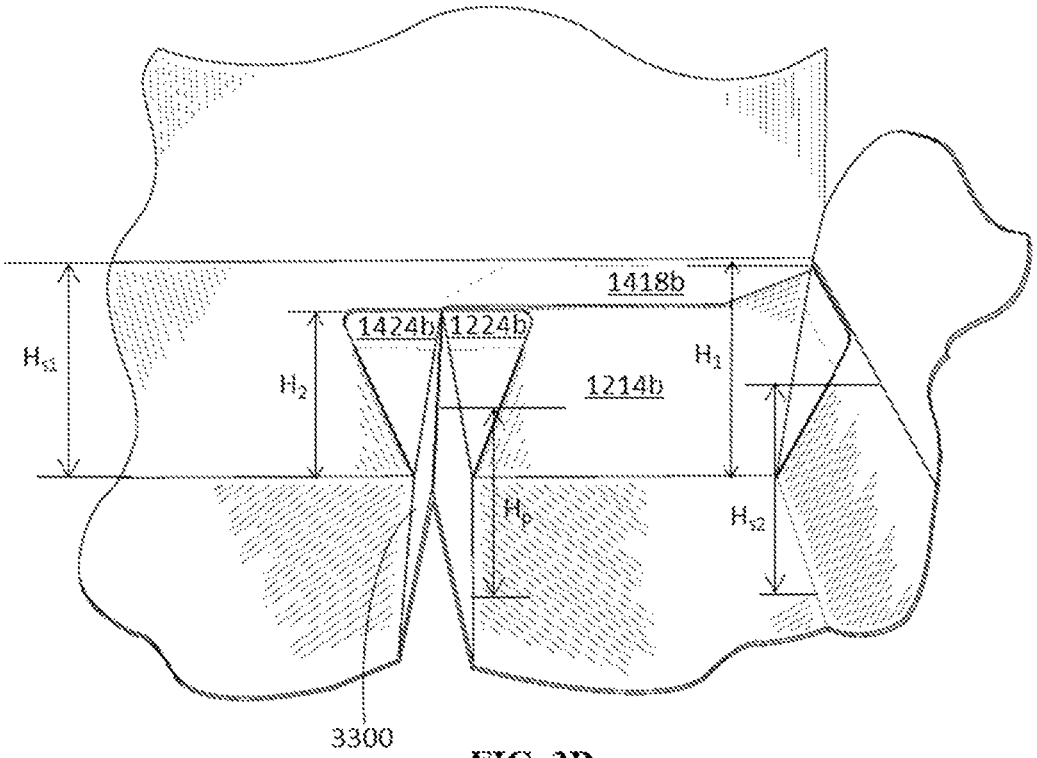

For each compartment, the heights of the three sidewalls ($H_s$), measured as the vertical distance from the bottom plane to the top edge of each wall, are substantially the same (see, e.g., FIG. 3D, $H_{s1}$ is approximately equal to $H_{s2}$).

1. Partition

The partition separates the first and second compartments and is formed from a pair of partition walls, which are joined to form a partition edge located at the top of the partition. Each partition wall extends upwardly from the bottom of its respective compartment at an angle equal to or greater than 90° relative to the bottom plane. A first partition wall of the first compartment meets the second partition wall of the second compartment at the partition edge, and the first and second partition walls align in the form of an inverted V shape, extending from the bottom plane. The height ($H_p$) of the partition (i.e. the vertical distance from the bottom plane to the partition edge) can be smaller than, or substantially equal to the height ($H_s$) of the sidewall (i.e. the vertical distance from the bottom plane to the top edge). This allows the partition to have a suitable height such that each of the four closure flaps can fold into a position that is substantially parallel with the bottom of the tray, such that the container is in a closed position (see, e.g., FIG. 5C) For example, as shown in FIG. 3D, $H_p$ is smaller than $H_s$. The partition is shorter than the sidewall, and allows each of the four closure flaps to fold into a position that is substantially parallel with the bottom of the tray, such that the container is in a closed position (see, e.g., FIG. 5C)

2. Compartments

Typically, each of the first and second compartments has a trapezoidal shape containing three sidewalls, a partition wall, a bottom, and four corners. For example, as illustrated in FIG. 5B, compartment 3400 contains three sidewalls 3414*a*, 3414*b*, and 3416, a partition wall 3412, and a bottom 1410. Two corners are located where the opposing sidewalls meet the third sidewall and the other two corners are located where the opposing sidewalls meet the partition wall. Each corner is formed by folding the gusset panels in each set of gusset panels, and adhering the resulting folded gusset to an adjacent sidewall or partition wall (see, e.g., FIG. 6B, corners 3510, 3520, 3530, and 3540). Thus each corner is adjacent to a folded gusset. Each of the first and second compartments contains a first, second, third, and fourth folded gusset.

In each compartment, two sidewalls are on a first set of opposite sides of the bottom (referred to as the opposing sidewalls) and are substantially upstanding, and the third sidewall and the partition wall are on a second set of opposite sides of the bottom and are substantially upstanding. Each of the sidewalls extends upwardly from the bottom at an angle equal to or greater than 90° relative to the bottom plane.

The folded gusset contacts and adheres to an interior surface of the opposing sidewall, the third sidewall, or the partition wall by an adhesive, thermal bonding (e.g. heat seal), or any other suitable technique. For example, the folded gusset contacts and adheres to an interior surface of the opposing sidewall or the third sidewall by heat seal. In embodiments in which the container does not need to be leak resistant (e.g. containers for holding dry food), the folded gusset can be located on an exterior surface of the container, for example the gusset can adhere to an exterior surface of one of the opposing sidewalls or the third sidewall.

Two adjacent opposing sidewalls of the first and second compartments form the front tray panel, and the other two adjacent opposing sidewalls of the first and second compartments form the rear tray panel. The two third sidewalls of the first and second compartments form the right and left side tray panels, respectively.

a. Folded Gussets

Each folded gusset includes a set of gusset panels, i.e. a first gusset panel and a second gusset panel, separated by a dividing fold line. The first and second gusset panels may have the same shape and/or size or different shapes and/or sizes.

Each corner is located where two sidewalls meet or where a sidewall meets a partition wall. Each corner in the container is formed by folding the gusset panels in the set of gusset panels such that one gusset panel, typically the larger gusset panel, covers the other, typically smaller, gusset panel in the set and adhering the resulting folded gusset to an adjacent sidewall or partition wall (see, e.g., FIG. 6B, corners 3510, 3520, 3530, and 3540).

In some embodiments, the first gusset panel has a shape and/or size that is different from the second gusset panel and the overall size of the first gusset panel is smaller than the second gusset panel. When the paperboard blank is folded and the container is assembled, the interior surface of a first gusset panel contacts and adheres to a gusset contacting portion of the interior surface of the adjacent opposing sidewall, third sidewall, or partition wall. Additionally, when folded, the second gusset panel covers the surface of the first gusset panel. The exterior surface of the portion of the second gusset panel that is larger than the first gusset panel generally contacts and adheres to the gusset contacting portion of the interior surface of the adjacent opposing sidewall, third sidewall, or partition wall. When the container is assembled, each of the folded gussets typically adheres to the gusset contacting portion of the interior surface of the adjacent opposing sidewall, the third sidewall, or the partition wall. In this manner, when folded, the interior surface of the second gusset panel is exposed to the interior of the compartment of the container, while the first gusset panel is covered by the second gusset panel. Similarly, when folded, the entire exterior surface of the first gusset panel overlaps with an exterior surface of the second gusset panel.

Figure 4:
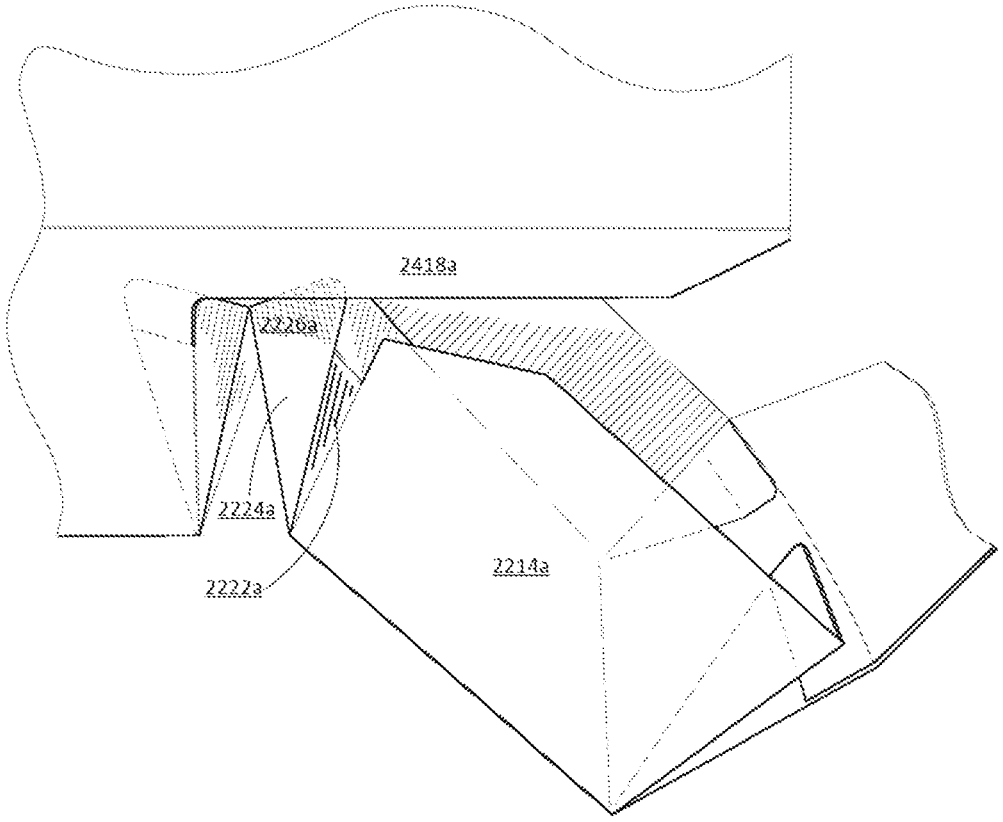
FIG. 4 is a partial view of the exterior surface of the blank depicted in FIGS. 2A-2C as it is being folded and assembled into the two-compartment container.

For example, FIGS. 3A-3D show the interior surfaces of the gusset panels when they are folded to form folded gussets 3220*b* and 3420*b* in FIG. 5B. As illustrated in FIG. 3A, the first gusset panel 1222*b* has a shape and/or size that is different from the second gusset panel 1224*b*, where the overall size of the first gusset panel 1222*b* is smaller than the second gusset panel 1224*b*. As illustrated in FIGS. 3B and 3C, when folded, the interior surface 1222*b* of the first gusset panel contacts and attaches to a gusset contacting portion 1228*b* of the interior surface of the adjacent opposing sidewall 1214*b*. FIG. 4 shows the exterior surfaces 2222*a* and 2224*a* of a set of gusset panels when they are partially folded to form a folded gusset 3220*a* in FIG. 5B. As illustrated in FIG. 4, when folded, the exterior surface 2224*a* of the second gusset panel covers the exterior surface 2222*a* of the first gusset panel. The exterior surface 2226*a* of the portion of the second gusset panel that is larger than the first gusset panel contacts and adheres to a gusset contacting portion of the interior surface of the adjacent opposing sidewall 1214*a* (not visible in FIG. 4; this surface is on the opposite surface of 2214*a*; see FIG. 1C). In this manner, when folded, the interior surface of the second gusset panel is exposed to the interior of the compartment of the container, while the first gusset panel is covered by the second gusset panel. Similarly, as illustrated in FIG. 3D, when folded, the interior surface 1224*b* of the second gusset panel is exposed to the interior of the compartment of the container, while the first gusset panel (1222*b*, shown as a dashed line beneath the second gusset panel 1224*b*) is covered by the second gusset panel.

Figure 10:
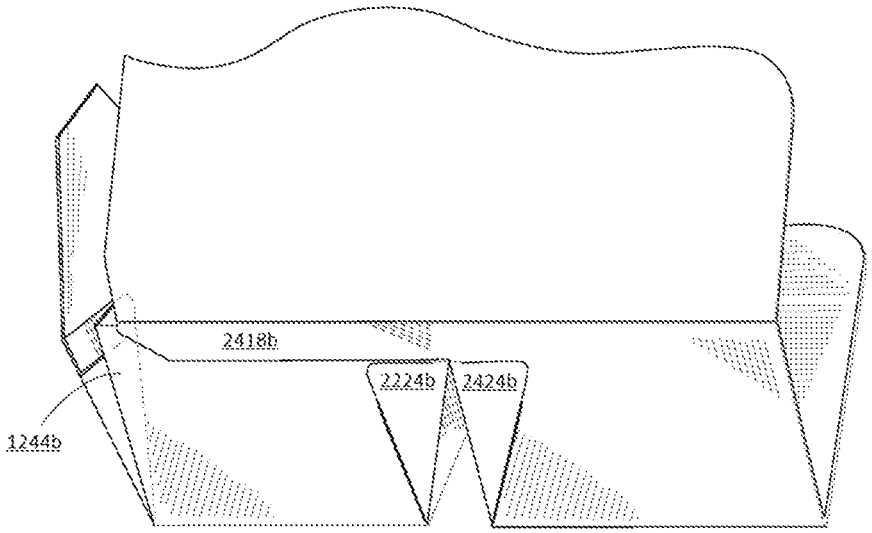
FIG. 10 is a partial view of the exterior surface of the blank depicted in FIGS. 2A-2C as it is being folded and assembled into a two-compartment container.
Figure 11:
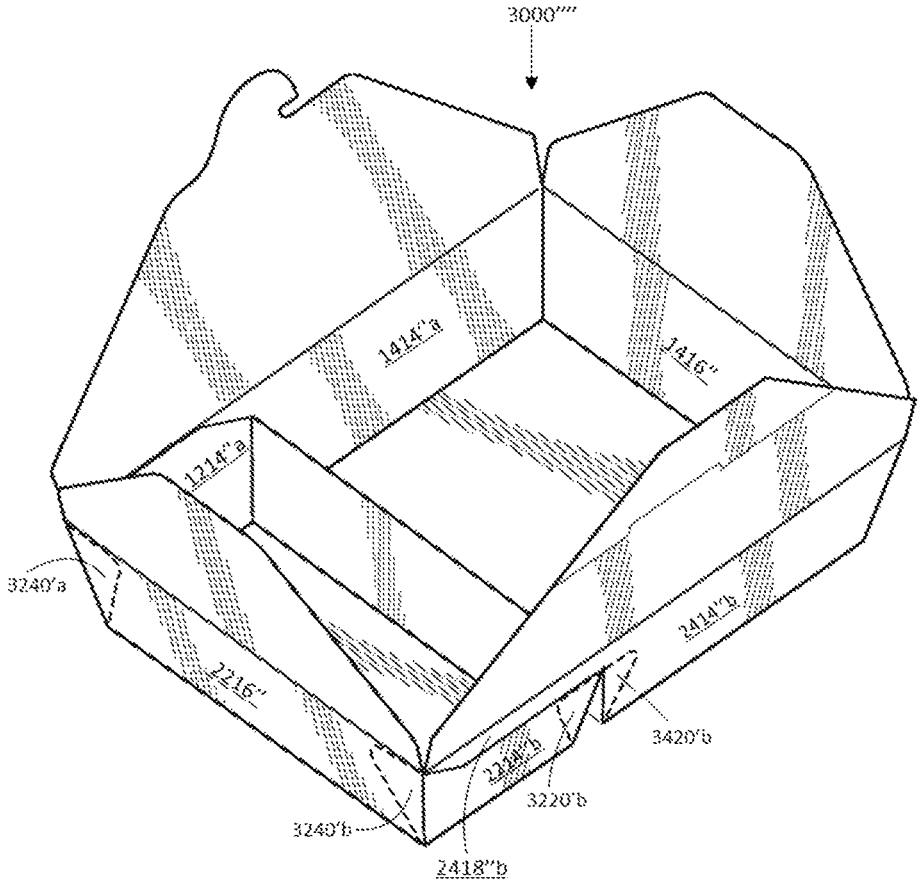
FIG. 11 depicts a top isometric view of a container with folded gussets and extension portions that contact and adhere to the exterior surfaces of the sidewalls (dashed lines indicate the boundaries of folded gussets that adhere to and are on top of the exterior surfaces of the sidewalls).

In embodiments in which the container is not leak resistant, one or more of the folded gussets, optionally all of the gussets, can be located outside of the compartment. In these embodiments, one or more of the folded gussets can be located on an exterior surface of the container, for example the gusset can adhere to an exterior surface of one of the opposing sidewalls or the third sidewall. The first gusset panel has a shape and/or size that is different from the second gusset panel and the overall size of the first gusset panel is smaller than the second gusset panel. When folded, the exterior surface of a first gusset panel contacts and attaches to a gusset contacting portion of the exterior surface of the adjacent opposing sidewall or third sidewall. Additionally, when folded, the second gusset panel covers the surface of the first gusset panel. The interior surface of the portion of the second gusset panel that is larger than the first gusset panel contacts and adheres to the gusset contacting portion of the exterior surface of the adjacent opposing sidewall or third sidewall. When the container is assembled, one or more, optionally each, of the folded gussets adheres to the gusset contacting portion of the exterior surface of the adjacent opposing sidewall or the third sidewall. In this manner, when folded, the exterior surface of the second gusset panel is exposed on the exterior surface of the compartment of the container, while the first gusset panel is covered by the second gusset panel. Similarly, when the paperboard blank is folded and the container is assembled, the entire interior surface of the first gusset panel overlaps with an interior surface of the second gusset panel. For example, as shown in FIG. 10, when folded, the exterior surfaces of the second gusset panels 2224*b* and 2424*b* are exposed and each is located on the exterior surface of a compartment of the container, while the first gusset panels (depicted as a dashed line beneath the second gusset panel 2224*b* and 2424*b*, respectively) are covered by the second gusset panels. As shown in FIG. 11, when the container 3000"" is assembled, each of the folded gussets (e.g. 3240'*a*, 3240'*b*, 3220'*b*, and 3420'*b*) and adheres to the gusset contacting portion of the exterior surfaces 2216", 2214"b, 2414"b of the opposing sidewall or the third sidewall (the other folded gussets are not visible in FIG. 11 as they are located on the exterior surfaces of the third sidewall 1416", and the exterior surfaces of the opposing sidewalls 1414"a and 1214"a).

The folded gusset typically adheres to an interior surface of the opposing sidewall, the third sidewall, or the partition wall by an adhesive, thermal bonding (e.g. heat seal), or any other suitable technique. For example, the interior surface of the container is coated with a heat sealable coating, such as a food grade heat sealable coating. Once the interior surface of the first gusset panel and an exterior surface of the second gusset panel are folded to contact an interior surface of the adjacent opposing sidewall, the third sidewall, or the partition wall, the folded gusset adheres to the wall by applying heat to the gusset contacting portion to form bonding between the contacted surfaces. In some embodiments, both the interior and the exterior surfaces of the container are coated with a heat sealable coating, and each of the folded gussets in the container can be sealed to an interior surface of one of its adjacent sidewalls (see, e.g. FIG. 10, 1244*b*, where the portion blocked by the opposing sidewall is shown as dashed lines) or the partition wall, or to an exterior surface of one of its adjacent sidewalls (see, e.g. FIGS. 10, 2224*b* and 2424*b*), as described above. In some embodiments, one or more of the folded gussets, optionally each of the folded gussets, adheres to an exterior surface of the opposing sidewall, the third sidewall, or the partition wall by an adhesive, thermal bonding (e.g. heat seal), or any other suitable technique.

In each compartment, the folded gussets connecting the third sidewall to each opposing sidewall can have the same size or a different size from the folded gusset connecting the partition wall to each opposing sidewall. For example, in embodiments in which the height of the partition wall ($H_p$) is smaller than the height of the sidewall ($H_s$), the folded gusset connecting the third sidewall to each opposing sidewall has a height ($H_1$) that is larger than the height ($H_2$) of the folded gusset connecting the partition wall to each opposing sidewall (see, e.g., FIG. 3D). Optionally in embodiments in which the height of the partition wall ($H_p$) is equal to or approximately equal to the height of the sidewall ($H_s$), the folded gusset connecting the third sidewall to each opposing sidewall has a height ($H_1$) that is equal to or approximately equal to the height ($H_2$) of the folded gusset connecting the partition wall to each opposing sidewall (not shown in the Figures).

b. Extension Portions

In one of the two compartments, each of the opposing sidewalls has an extension portion on one end of the opposing sidewall that connects to the adjacent opposing sidewall. Each of the extension portions contacts and adheres to an extension contacting portion of its adjacent opposing sidewall, which corresponds with one of the opposing walls of the other compartment (i.e. the corresponding opposing sidewall). Typically, an exterior surface of each extension portion contacts and adheres to an interior surface of its corresponding opposing sidewall in the container. For example, as shown in FIG. 5B, each of the opposing sidewalls 3414*a* and 3414*b* has an extension portion 1418*a* or 1418*b*. Each of the extension portions 1418*a* and 1418*b* adheres to its adjacent sidewall 1214*a* or 1214*b*, respectively.

Alternatively, in embodiments in which the container does not need to be leak resistant, an interior surface of each extension portion contacts and adheres to an exterior surface of its corresponding opposing side tray panel in the container (see, e.g. FIG. 10, extension portion 2418*b* and FIG. 11, extension portion 2418"b).

Figure 9A:
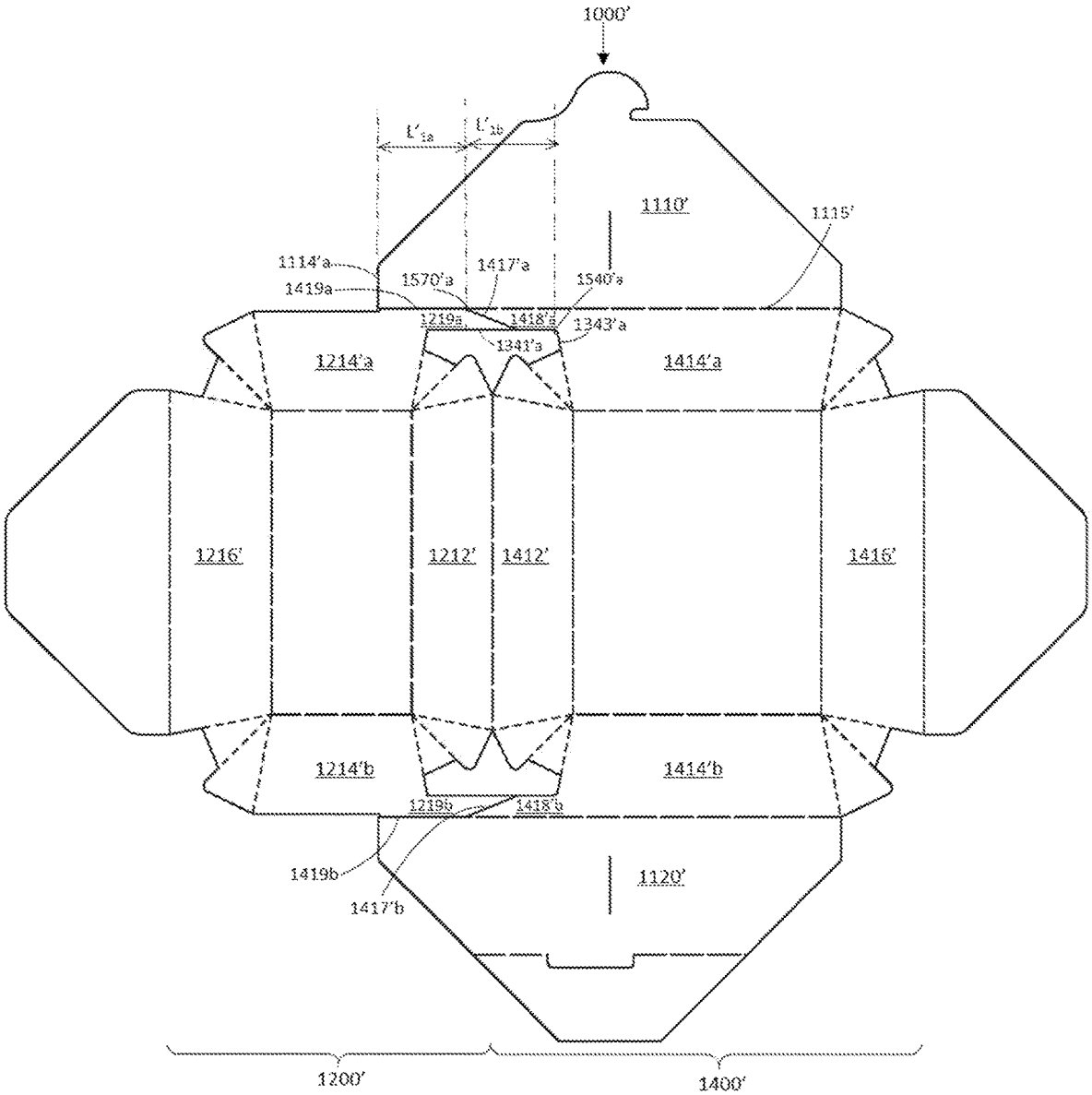
FIGS. 9A-9B are the same plan view of the interior surface of an exemplary blank configured to form a two-compartment container with a tray and four closure flaps, where each compartment in the tray has a rectangular bottom, and where each compartment contains an extension portion on each opposing sidewall (dashed lines indicate fold lines and solid lines indicate cut lines).
Figure 9B:
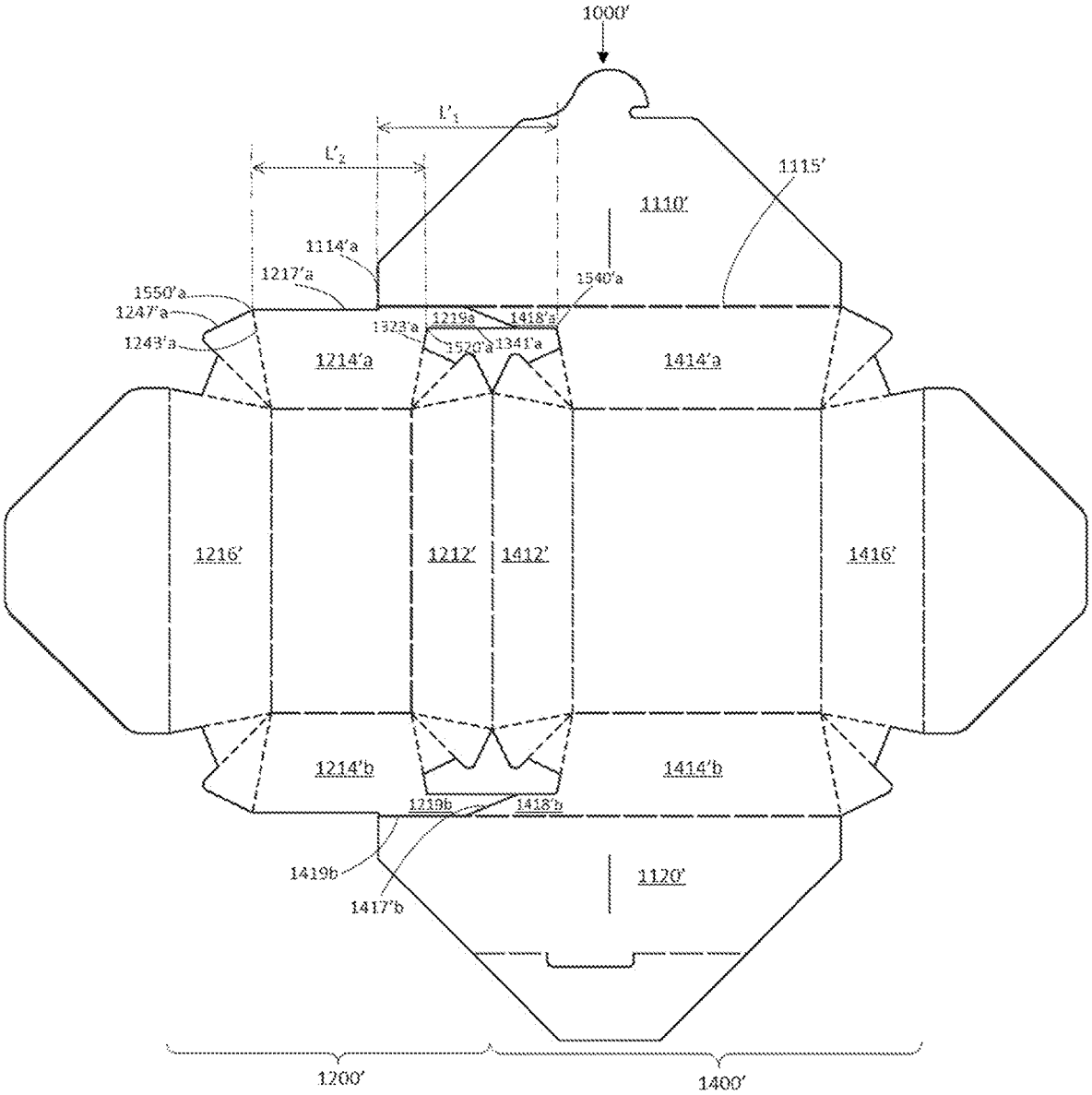

Optionally, the other compartment in the container also contains an extension portion on one or both of its opposing sidewalls (see, e.g. FIGS. 9A and 9B, first extension portions 1219*a* and 1219*b* in the first tray portion 1200' and second extension portions 1418'*a* and 1418'*b* in the second tray portion 1400'). In some embodiments, where both compartments contain an extension portion on an opposing sidewall, an exterior surface of each extension portion of the first compartment contacts and adheres to an interior surface of its corresponding opposing sidewall; an interior surface of each extension portion of the second compartment contacts and adheres to an exterior surface of its corresponding opposing sidewall. In other embodiments, where both compartments contain an extension portion on an opposing sidewall, an exterior surface of each extension portion of the second compartment contacts and adheres to an interior surface of its corresponding opposing sidewall; an interior surface of each extension portion of the first compartment contacts and adheres to an exterior surface of its corresponding opposing sidewall.

Each extension portion can adhere to the extension contacting portion of the corresponding opposing sidewall by an adhesive, thermal bonding (e.g. heat seal), or any other suitable technique. For example, the interior surface of the container is coated with a heat sealable coating, such as a food grade heat sealable coating; once an exterior surface of the extension portion is brought in contact with an interior surface of its corresponding opposing sidewall, it adhere thereto by applying heat to the extension contacting portion to form bonding between the contacted surfaces. Alternatively, once an interior surface of the extension portion is in contact with an exterior surface of its corresponding opposing sidewall, it is sealed thereto by applying heat to the extension contacting portion to form bonding between the contacted surfaces.

Figure 3E:
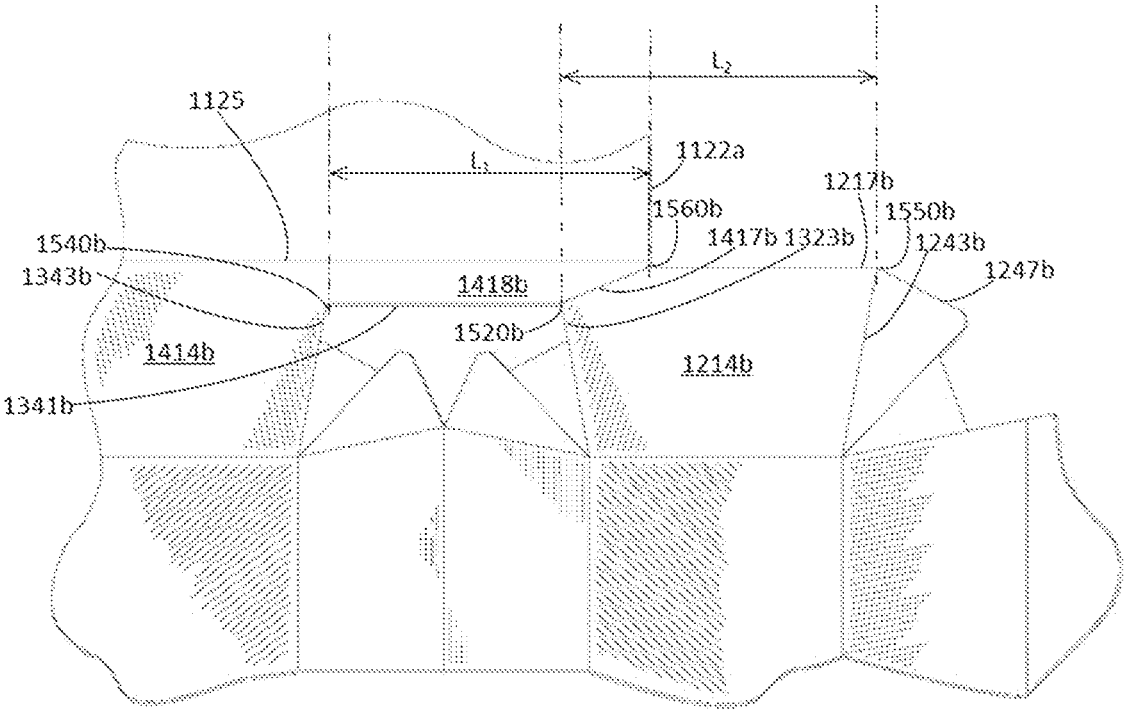

In some embodiments, an extension portion and a folded gusset contact and adhere to the same opposing sidewall. The largest length ($L_1$) of the extension portion can be different from, or the same as or similar to the largest length ($L_2$) of the corresponding opposing side tray panel. For example, as shown in FIG. 3E, the largest length $L_1$ of the extension portion 1418*b* is the same as or similar to the largest length $L_2$ of the corresponding opposing side tray panel 1214*b*. As illustrated in FIG. 3E, cut lines 1341*b* and 1343*b* meet at a first corner 1540*b*, and cut lines 1417*b* and

1217*b* meet at a second corner 1560*b*. $L_1$ is measured from a first imaginary measuring line that is perpendicular to cut line 1341*b* and runs through the first corner 1540*b* to a second imaginary measuring line that is perpendicular to cut line 1217*b* and runs through the second corner 1560*b*. The second imaginary measuring line overlaps with cut line 1122*a*, which defines an outer boundary of the front flap portion 1120. For measuring $L_2$, cut lines 1341*b* and 1417*b*, and 1323*b* meet at a third corner 1520*b*, and cut lines 1217*b* and 1247*b*, and fold line 1243*b* meet at a fourth corner 1550*b*. $L_2$ is measured from a third imaginary measuring line that is perpendicular to cut line 1341*b* and runs through the third corner 1520*b* to a fourth imaginary measuring line that is perpendicular to cut line 1217*b* and runs through the fourth corner 1550*b*.

Optionally, $L_1$ can be shorter than $L_2$ (not shown in the Figures). For example, in such embodiments, instead of the cut line 1417*b* separating the extension portion from its corresponding opposing side tray panel, a second cut line would be present, which reduces the length of the extension portion (not shown in Figures).

The two-compartment container is liquid tight, and typically each of the compartments contains four folded gussets adhered to an opposing sidewall, optionally two of the gussets adhere to the partition wall. Further, typically the extension portion of one or both compartments adheres to adheres to an extension contacting portion of the adjacent opposing sidewall, optionally via thermal bonding.

B. Closure Flaps

Each of the four closure flaps is connected to one side of a sidewall via a top edge that is located opposite to the bottom edge, which connects the sidewall to the bottom. The term "top edge" includes the top edge of any sidewall, such as the top edge of a third sidewall, the top edge of an opposing sidewall without an extension portion, and the top edge of an opposing sidewall that contains an extension portion. The term "extended top edge" refers specifically to the top edge on an opposing sidewall that contains the extension portion.

Generally, each of two opposing closure flaps is connected to one third sidewall of the first or second compartment (referred to as the left and right closure flaps, respectively); the other two opposing closure flaps are on opposite sides of the tray and each is connected to one opposing sidewall of the first or second compartment that contains an extension portion (referred to as the front and rear closure flaps, respectively). For example, when only one compartment contains two opposing sidewalls containing extension portions, each of the front and rear closure flaps is connected to one opposing sidewall containing an extension portion via an extended top edge.

For example, the first closure flap is hingedly connected to the third sidewall of the first compartment via a first top edge; the second closure flap is hingedly connected to the third sidewall of the second compartment via a second top edge; the third closure flap is hingedly connected to a first opposing sidewall that contains the extension portion via a first extended top edge; and the fourth closure flap is hingedly connected to a second opposing sidewall that contains the extension portion via a second extended top edge. The first and the second opposing sidewalls that contain the extension portions are located on opposing sides of the same compartment.

Figure 6A:
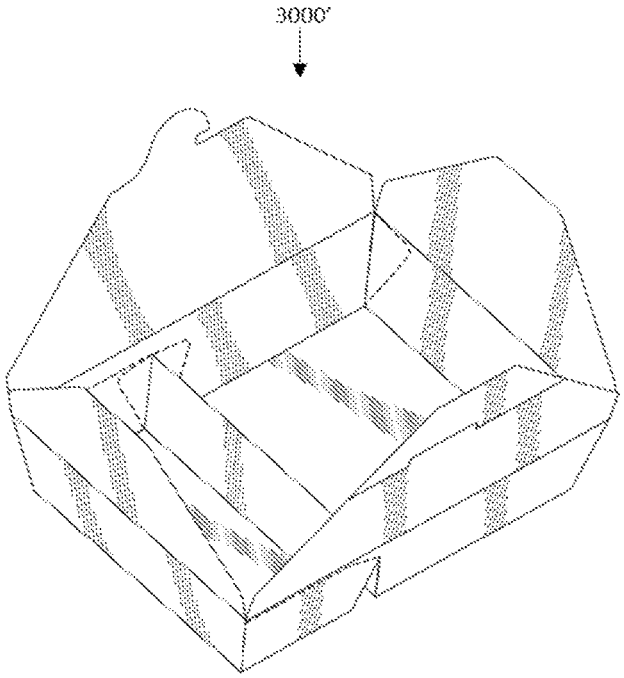
FIGS. 6A-6D are four views of the resulting two-compartment container when the blank depicted in FIGS. 1A-1D is assembled, with the exception that the relief cuts are not depicted in the closure flaps of FIGS. 6A-6C (dashed lines indicate the boundaries of folded gussets or extension portions that adhere to and are on top of the interior surfaces of the sidewalls (FIGS. 6A and 6B), or the boundary of the exterior surface of the sidewall that adheres to the extension portion of its corresponding opposing sidewall (FIG. 6C)).
Figure 6B:
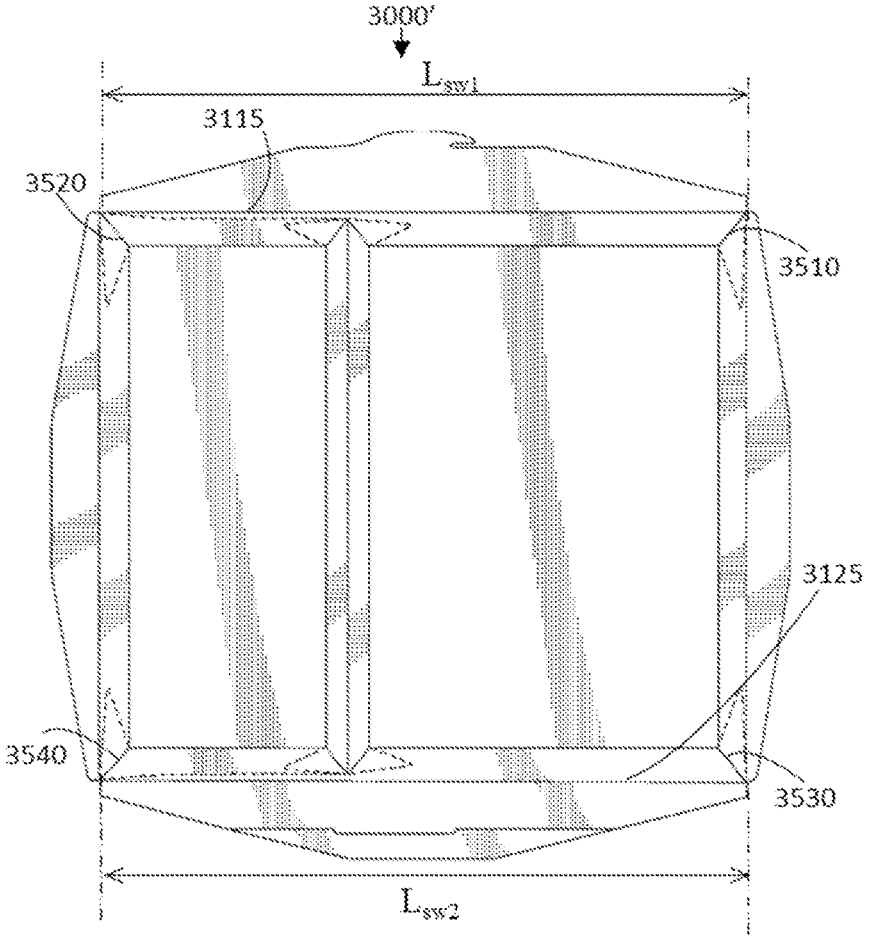
Figure 6C:
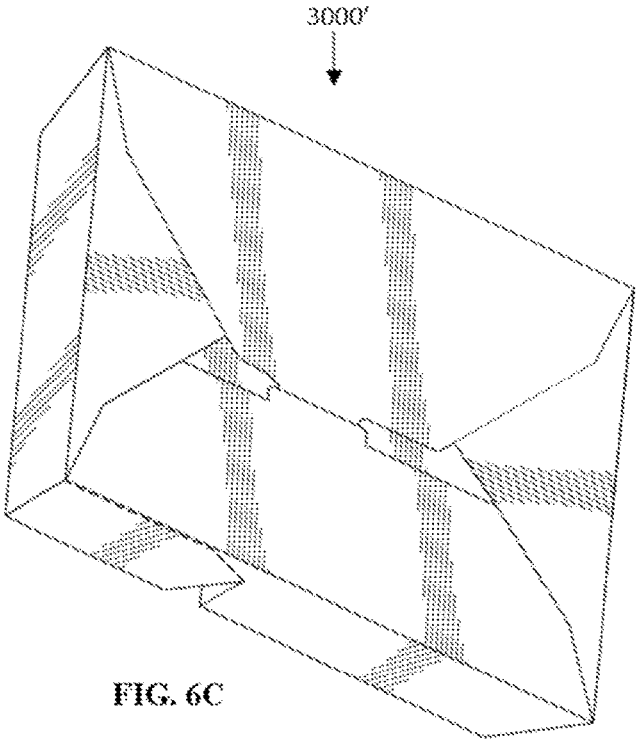
Figure 6D:
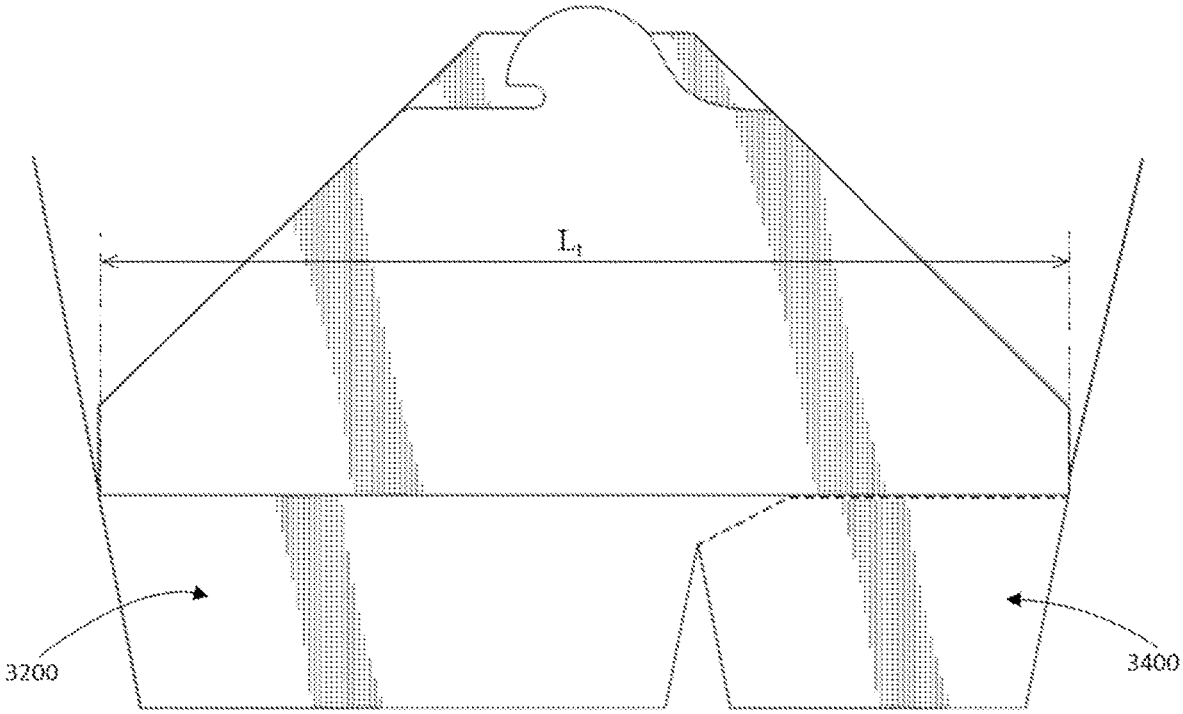

Typically, the length of each of the first and second opposing sidewalls ($L_{sw1}$ and $L_{sw2}$) (see FIG. 6B), where each contains an extension portion, is the same as or similar to the length of the tray ($L_t$) (see FIG. 6D). The length of the first or second sidewall corresponds with the greatest length of the sidewall, including the extension portion, and can be measured by an imaginary measuring line from corner 3510 to corner 3520 that is parallel to top edge 3115 (or by an imaginary measuring line from corner 3530 to corner 3540 that is parallel to top edge 3125).

One or more of the closure flaps may be removable from the container. For example, one or more top edges of the sidewalls that connect the closure flap(s) are perforated to facilitate removal of the closure flap(s) along the top edges of the tray (see, e.g. FIG. 8, 3115", 3125", 3135", and 3145"). Alternatively, one or more top edges of the sidewalls that connect the closure flap(s) are scored, laser cut, embossed, or weakened to facilitate the removal of the closure flap(s) from the container, such as by a user pulling on the closure flap(s). In use, the closure flaps can be closed and locked to protect the contents of the container. When the closure flaps are in the open position, they can be removed to form a two-compartment container that does not contain the additional closure flaps, facilitating access to and removal of the contents inside the container. When the closure flaps are removed, then the container is an open two-compartment container or bowl.

1. Tab and Slit

One of the four closure flaps may contain a tab, and the closure flap located opposite it may contain a slit, which corresponds to the size and shape of the corresponding tab. The tab can have any suitable size and shape that is configured to fit inside the corresponding slit on the opposing closure flap. Suitable shapes for the tab include, but are not limited to, a hook tab, such as a right hook tab, a left hook tab, or a double hook tab, and a tuck tab. An exemplary hook tab is shown in FIG. 5B, 1112. The slit can be a single cut line having a suitable shape and size to receive the corresponding tab, such as a curved cut line (convex or concave), a straight cut line, or other suitable shapes to receive the corresponding tab. Optionally, one or more additional cut lines are arranged perpendicularly to the slit, such as located on each side of the slit, in the middle of the slit, or on each side and the middle of the slit. For example, as shown in FIG. 5B, the slit is a single straight cut line 1121 with curved edges; two additional cut lines 1129*a* and 1129*b* are perpendicular to and located on each side of the slit 1121. The additional cut lines are configured to facilitate the insertion and removal of the tab from the slit.

After food items are placed in each compartment of the tray, each of the four closure flaps folds inwardly and downwardly into a position above and substantially parallel with the bottom of the tray to close the container. The closure flaps can secure the closed container in a locked position by inserting the tab into the slit.

For example, one of the front or rear closure flaps includes a tab, and its opposing closure flap includes a slit. When transferring from the open position to the closed position, the left and right closure flaps are folded into a position that is substantially parallel with the bottom; and the front and rear closure flaps are folded on top of the left and right flaps. The front and rear closure flaps secure the container in a closed and locked position by inserting the tab into the slit. In this manner, when the container is in the closed and locked position, a portion of each of the left and right closure flaps is under and covered by a portion of the front and rear closure flaps.

The closure flap containing the slit may include one or more fold lines, which allow a container to be filled such that its flap closures bulges, yet the container can be secured in the closed and locked positon. For example, as shown in FIG. 5B, two fold lines 1127*a* and 1127*b* are substantially parallel to the slit 1121; each fold line connects an end point of one perpendicular cut line 1129*a* or 1129*b*, and extends to one edge of the closure flap.

A consumer receiving the container with food items placed therein, can open the container by applying a force to the tab to pull it out of or remove it from the slit to access the food items. After the container is opened, the consumer can remove one or more of the closure flaps along the corresponding top edge(s) to make the food items placed in the compartments easier to access and consume. In some embodiments, the consumer can remove one or more of the closure flaps along the corresponding top edge(s) to access the food items without pulling the tab out of or removing it from the slit.

C. Optional Features

1. Windows

Optionally, the tray and/or one or more closure flaps includes one or more openings that allow one to view the contents in the interior of the compartment(s) and/or permit assessment of the food item or items inside the compartment (s) when the container is assembled from the blank and when the container is in a closed position. The opening can be covered by a film, plastic, or other covering made of a transparent material that forms a window to allow the food items inside the container to be viewed or otherwise inspected or assessed therethrough, even when the container is in a closed position. Suitable materials include acetate film (e.g. 1 mil. thick), polyester film (e.g. 1 mil. thick), or anti-fog polypropylene film (e.g. 1 mil thick). Depending upon whether the container is desired to be microwaveable, oven safe and/or refrigerator safe, different materials may be chosen to cover the opening.

Figure 7:
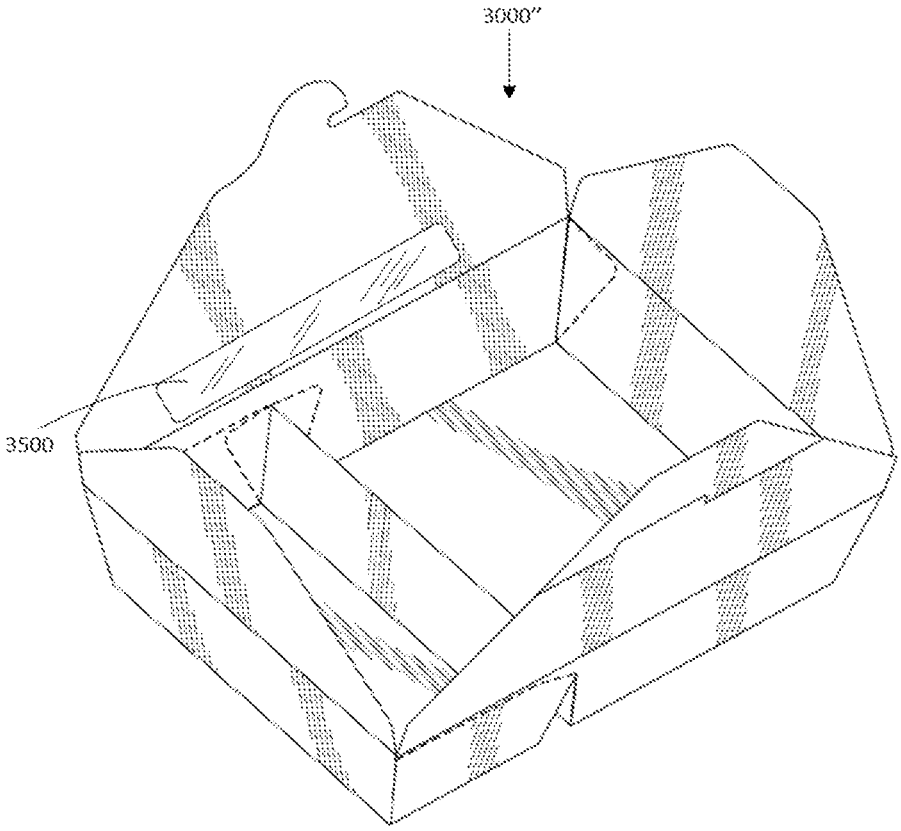
FIG. 7 depicts a top isometric view of a container with a window in one of the closure flaps (dashed lines indicate the boundaries of folded gussets or extension portion that adhere to and are on top of the interior surfaces of the sidewalls, or the boundary of the exterior surface of the sidewall that adheres to the extension portion of its corresponding opposing sidewall).

The opening can have any suitable shape, size, and configuration. The opening can be located in a variety of different locations. The opening can be in a regular shape, such as a rectangle, square, oval, circle, etc. The opening can be in an irregular shape. The opening may be located in the tray, such as on the front tray panel (e.g. on one or both of the opposing sidewalls), on the rear tray panel (e.g. on one or both of the opposing sidewalls), and/or on one or both of the side tray panels, and/or in one or more closure flaps (see, e.g. FIG. 7, opening 3500). The opening will generally not be located where a slit is present.

Optionally, the opening can contain multiple openings, which can be covered by a single covering or which can be covered by multiple coverings made of a transparent material to form one or more than one windows.

2. Identifying Markings

Optionally, one compartment or both compartments and/or one or more closure flaps include identifying markings, such as to indicate the direction the container should be placed to prevent accidental spillage of the food contents (e.g. with an arrow or "this side up" marking), and/or to label the food item(s) in each compartment. Logos or other decorative or informative markings can also be included on the compartment(s) and/or the closure flap(s), as desired.

3. Relief Cuts

Optionally, the tray and/or closure flap(s) include relief cuts. The relief cuts allow for heat and steam to escape from the container, when the container is in the closed position and when a hot substance, such as hot food, is enclosed therein. The relief cuts may be a single cut located on one or more of the closure flaps (see, e.g. FIG. 5B, 1113 and 1123), or multiple cuts located on one or more closure flaps.

Optionally, the relief cuts have a suitable size and shape to receive utensils, such as the handle portion of cutlery or a portion of chopsticks.

In some embodiments, the two-compartment container does not contain any relief cuts, such as 3000' illustrated in FIGS. 6A-6C.

II. Blank

A blank, such as a paperboard blank, is used to form the paper two-compartment leak-proof container described herein.

A. Blank Materials

The blank is formed from a foldable material, such as paper-based material such as paperboard or corrugated sheet material, although other materials may be used if desired. In embodiments utilizing paperboard, the paperboard may be virgin or recycled material, may be coated or uncoated, and may be single-ply or laminated paperboard.

The foldable material may be Folding Box Board (FBB). FBB is a chemically and mechanically generated multiply pulp material making it strong and durable. FBB generally includes a bleached chemical layer.

The foldable material may be Solid Bleached Sulfate (SBS) Board. This type of board is formed by chemically pulping fibers and then bleaching it. The bleached pulp is refined and formed into boxes. SBS boxes generally contain white surfaces on the inside and outside of the box. SBS can be coated on only one side (C1S) or on both sides (C2S).

FBB and SBS board are produced from virgin fibers and are generally suitable for all types of product packaging. SBS board quality also allows special processes such as embossing & debossing, hot foil stamping or spot UV printing due to its grade quality.

The foldable material may be Natural Kraft or Coated Unbleached Kraft (SUS or CUK). This type of board is made from 100% recyclable materials, and is often used for Kraft packaging. When coated with polyethylene (PE) resin, this board can be used to make food packaging of wet strength. At least 80% of virgin unbleached wood pulp is used to make CUK. This type of board is strong and durable; the stiffness leads to high resistance to tearing making the board long-lasting. The printing quality of the board can be improved by coating the surface with a thin layer of kaolin clay.

The foldable material may be from about 0.012 inch to about 0.024 inch thick, although it may have any suitable thickness. In some embodiments, the foldable material may be solid bleached sulfate (SBS) with ½ mil low density polyethylene (LDPE), while in other embodiments the foldable material may be SBS with ¾ mil LDPE, while in still yet other embodiments, any other suitable foldable material may be used.

Different types of food grade paperboard may be used to form the blank and ultimately the container. The paperboard is optionally ovenable paperboard suitable for use in conventional and microwave ovens.

The paperboard may be coated with a suitable food grade material to reduce leakage, such as a polyester resin film. Optionally, the side of the paperboard blank that forms the interior surface of the resulting tray is coated with a liquid impervious polymer film. Optionally, the blank is coated on one side, which will serve as the inside surface of the resulting container, with a clay-coat, which is cured with a UV or electron beam varnish.

B. Paperboard Blank

A paperboard blank forming the container has an interior surface and an exterior surface. When the blank is assembled to form the container, the interior surface forms two compartments into which food items can be placed. The paperboard blank contains a central polygonal bottom panel (referred to as the tray portion; see, e.g. FIG. 1B, tray portion 1100 defined by the dash-dotted lines), which forms the two compartments of the tray when it is assembled into a container, and four polygonal top panels (referred to as the flap portions), which form the closure flaps when the blank is assembled into a container. Each of the four flap portions is connected to the tray portion via a fold line.

1. Tray Portion

The tray portion contains a first polygonal panel (referred to as the first tray portion; see, e.g. FIG. 1C, first tray portion 1200 defined by the dash-dotted lines), which forms the first compartment of the tray when it is assembled, a second polygonal panel (referred to as the second tray portion; see, e.g. FIG. 1D, second tray portion 1400 defined by the dash-dotted lines), which forms the second compartment of the tray when it is assembled, and two polygonal panels connecting the first tray portion and the second tray portion (referred to as the cut-out portions; see, e.g. FIG. 1B, cut-out portions 1310*a* and 1310*b*), which are removed when the compartments of the tray are formed. The first tray portion is connect to the second tray portion via a central fold line.

Each of the first and second tray portions includes a bottom tray panel, three side tray panels, four sets of gusset panels, and an interior partition panel; each of the side tray panels and the interior partition panel is connected to one side of the bottom tray panel via a fold line. The fold lines between the bottom tray panel and each side tray panel or the interior partition panel form the bottom edges of the first and second compartments when the blank is assembled into a container.

The first bottom tray panel may have the same shape as the second bottom panel or a shape that is different from the second bottom tray panel. For example, each of the first and second bottom tray panels is in the shape of a rectangle. For example, each of the first and second bottom tray panels is in the shape of a square. Each bottom tray panel may also be in the shape of other polygons. When the first and second bottom tray panels have the same shape, the first bottom tray panel may have the same size as the second bottom tray panel or a size that is different from the second bottom tray panel. For example, each of the first and second bottom tray panels is in the shape of a rectangle, and the size of the first bottom tray panel is smaller than the size of the second bottom tray panel (see, e.g. FIG. 1A, first bottom tray panel 1200 and second bottom tray panel 1400). Alternatively, the second bottom tray panel can be smaller than the first bottom tray panel. Optionally, the size of the first bottom tray panel is equal to or approximately equal to the size of the second bottom tray panel. In such embodiments, the partition panel is located at or approximately at the center of the bottom tray panel (not shown in the Figures). For example, the partition panels 1212 and 1412 would be located towards the center of the bottom tray portion 1100, such that the first bottom tray portion 1200 has a size that is equal to or approximately equal to the second bottom tray portion 1400. Optionally, each of the first and second bottom tray panels is in the shape of a rectangle, and the size of the first bottom tray panel is equal to or approximately equal to the size of the second bottom tray panel.

a. Tray Panels and Gusset Panels

In each of the first and second tray portions, each side tray panel and the interior partition panel connect to the bottom tray panel via a fold line. Two side tray panels are located on a first set of opposite sides of the bottom tray panel (referred to as the opposing side tray panels) and the third side tray panel and the partition panel are located on a second set of opposite sides of the bottom tray panel. Each of the opposing side tray panels is located between the third side tray panel and the partition panel and is connected to the third side tray panel via a first set of gusset panels and to the partition panel via a second set of gusset panels.

i. Cut-Out Portions

Figure 1A:
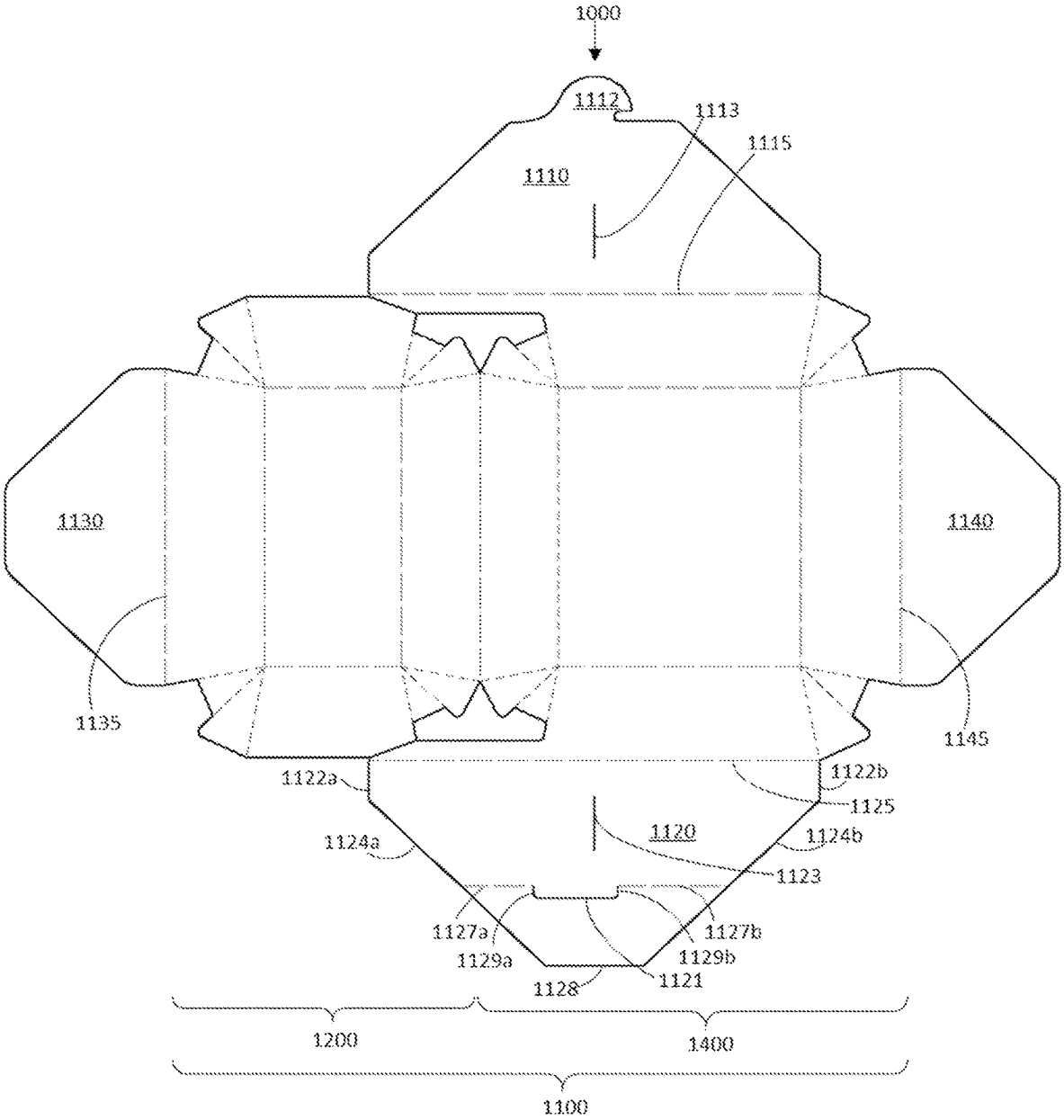
FIGS. 1A-1D are plan views of the interior surface of an exemplary blank configured to form a two-compartment container with a tray and four closure flaps, where each compartment in the tray has a rectangular bottom.
Figure 1B:
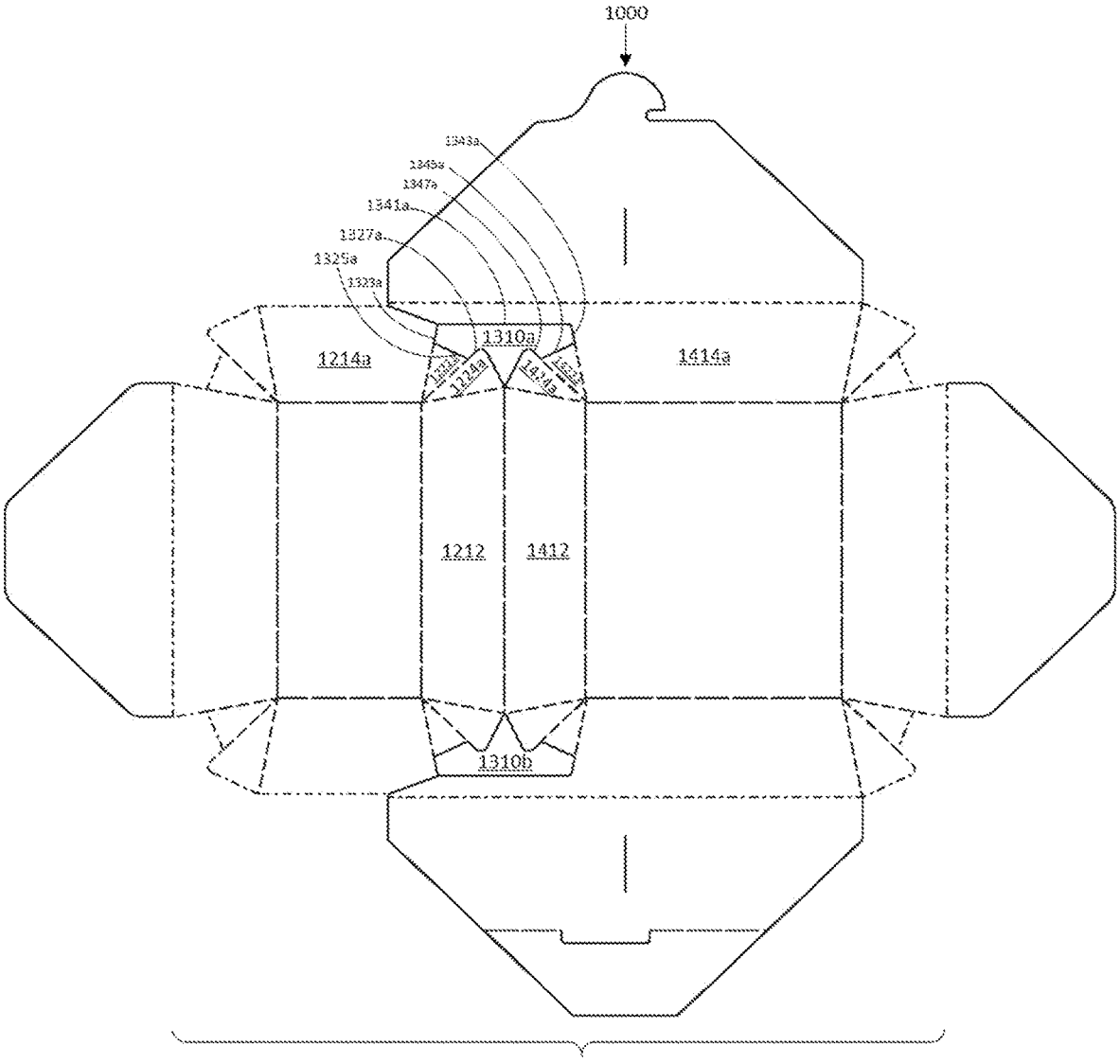

Each of the two cut-out portions is located between one opposing side tray panel of the first tray portion and its adjacent opposing side tray panel of the second tray portion (referred to as the corresponding opposing side tray panel). Each cut-out portion is defined by cut lines and forms an open region that separates a first opposing side tray panel and a first set of gusset panels in the first tray from a second opposing side tray panel and a second set of gusset panels in the second tray. The set of gusset panels of the first tray portion is adjacent to the set of gussets panels of the second tray portion For example, as illustrated in FIG. 1B, a cut-out portion 1310*a* is located between the opposing side tray panel 1414*a* and its corresponding opposing side tray panel 1214*a*. The cut-out portion 1310*a* is defined by cut lines 1341*a*, 1343*a*, 1323*a*, 1325*a*, 1327*a*, 1347*a*, and 1345*a*. The cut-out portion 1310*a* forms an open region that separates the opposing side tray panel 1214*a* and gusset panels 1222*a* and 1224*a* in the first tray panel 1200 from the opposing side tray panel 1414*a* and gusset panels 1422*a* and 1424*a*. Similarly, as shown in FIG. 1B, a cut-out portion 1310*b* is located between the opposing side tray panel 1414*b* and its corresponding opposing side tray panel 1214*b*. The cut-out portion 1310*b* forms an open region that separates the opposing side tray panel 1214*b* and gusset panels 1222*b* and 1224*b* in the first tray panel 1200 from the opposing side tray panel 1414*b* and gusset panels 1422*b* and 1424*b*.

ii. Gusset Panels

In each set of two gusset panels, each gusset panel is connected to the adjacent side panel or the adjacent partition panel via a fold line and each gusset panel is connected to the other gusset panel via a dividing fold line. The dividing fold line divides the set of gusset panels into a first gusset panel and a second gusset panel.

The first and second gusset panels may have the same shape and/or size or different shapes and/or sizes. For example, the first gusset panel has a shape and/or size that is different from the second gusset panel. In some embodiments, the first gusset panel has a shape and/or size that is different from the second gusset panel and the overall size of the first gusset panel is smaller than the second gusset panel.

iii. Removal of the Cut Out Portions and Folding of the Gusset Panels

When the paperboard blank is folded and the container is assembled, the two cut-out portions located at the opposite side of the interior partition panels, connecting the first and second tray portions, are "cut out" of or removed from the blank.

The three side tray panels extend outwardly from the bottom panel of each of the first and second tray portions, such that they are angled away from the bottom panel at an angle equal to or greater than 90° when the tray is assembled into a container. As the side tray panels fold, each set of gusset panels folds inwardly along the dividing fold line, such that a surface of either one or both of the first and second gusset panels contacts a gusset contacting portion of the interior surface of the adjacent side tray panel (either an opposing side tray panel or the third side tray panel) or the partition wall.

In embodiments where the first gusset panel has a shape and/or size that is different from the second gusset panel and the overall size of the first gusset panel is smaller than the second gusset panel, when folded, the interior surface of a first gusset panel contacts and attaches to a gusset contacting portion of the interior surface of the adjacent opposing sidewall, third sidewall, or partition wall. Additionally, when folded, the second gusset panel covers the surface of the first gusset panel. The exterior surface of the portion of the second gusset panel that is larger than the first gusset panel contacts and adheres to the gusset contacting portion of the interior surface of the adjacent opposing sidewall, third sidewall, or partition wall.

For example, FIGS. 3A-3D show the interior surfaces of the gusset panels when they are folded to form folded gussets 3220*b* and 3420*b* in FIG. 5B. As illustrated in FIG. 3A, the first gusset panel 1222*b* has a shape and/or size that is different from the second gusset panel 1224*b*, and the overall size of the first gusset panel 1222*b* is smaller than the second gusset panel 1224*b*. As illustrated in FIGS. 3B and 3C, when folded, the interior surface 1222*b* of the first gusset panel contacts and attaches to a gusset contacting portion 1228*b* of the interior surface of the adjacent opposing sidewall 1214*b*. FIG. 4 shows the exterior surfaces 2222*a* and 2224*a* of a set of gusset panels when they are partially folded to form a folded gusset 3220*a* in FIG. 5B. As illustrated in FIG. 4, when folded, the exterior surface 2224*a* of the second gusset panel covers the exterior surface 2222*a* of the first gusset panel. The exterior surface 2226*a* of the portion of the second gusset panel that is larger than the first gusset panel contacts and adheres to a gusset contacting portion of the interior surface of the adjacent opposing sidewall 1214*a* (not visible in FIG. 4; this surface is on the opposite surface of 2214*a*; see FIG. 1C). In this manner, when folded, the interior surface 1224*a* of the second gusset panel is exposed to the interior of the compartment of the container, while the first gusset panel 1222*b* (not visible in FIG. 3D) is covered by the second gusset panel.

Alternatively, in embodiments where the container is not leak resistant, the blank is folded such that one or more of the sets of gusset panels, optionally each set of gusset panels, folds outwardly along the dividing fold line. In these embodiments, a surface of either one or both of the first and second gusset panels contacts a gusset contacting portion of the exterior surface of the adjacent side tray panel (either an opposing side tray panel or the third side tray panel). When the first and second gusset panels are folded, the exterior surface of a first gusset panel contacts and attaches to a gusset contacting portion of the exterior surface of the adjacent opposing sidewall or third sidewall. Additionally, when folded, the second gusset panel covers the surface of the first gusset panel. The interior surface of the portion of the second gusset panel that is larger than the first gusset panel contacts and adheres to the gusset contacting portion of the exterior surface of the adjacent opposing sidewall or third sidewall.

For example, as shown in FIG. 10, when folded, the exterior surfaces of the second gusset panels 2224*b* and 2424*b* are exposed on the exterior surface of the compartment of the container, while the first gusset panels (shown as a dashed line beneath the second gusset panel 2224*b* and 2424*b*, respectively) are covered by the second gusset panels. As shown in FIG. 11, when the container 3000"" is assembled, each of the folded gussets (e.g. 3240'*a*, 3240'*b*, 3220'*b*, and 3420'*b*) adheres to the gusset contacting portion of the exterior surfaces 2216", 2214"b, 2414"b of the adjacent opposing sidewall or the third sidewall (the other folded gussets are not visible in FIG. 11 as they are located on the external surfaces of the third sidewall 1416", and the external surfaces of the opposing sidewalls 1414"a, and 1214"a).

iv. Extension Portions

In at least one of the two tray portions, each of the opposing side tray panels has an extension portion on the opposite end of the opposing side tray panel that connects to the third side tray panel. Each of the extension portions extends toward its adjacent side tray panel, which corresponds with one of the opposing side tray panels of the other tray portion (i.e. the corresponding opposing side tray panel). The extension portion is separated from its corresponding opposing side tray panel via a cut line. The cut line defines the shape of an extension contacting portion of the corresponding opposing side tray panel. The largest length ($L_1$) of the extension portion can be equal to or approximately equal to, or different from the largest length ($L_2$) of the corresponding opposing side tray panel. Typically, the largest length of the extension portion is equal to or approximately equal to the largest length of the corresponding opposing side tray panel (see, e.g., FIG. 3E, $L_1$ and $L_2$).

Figure 1C:
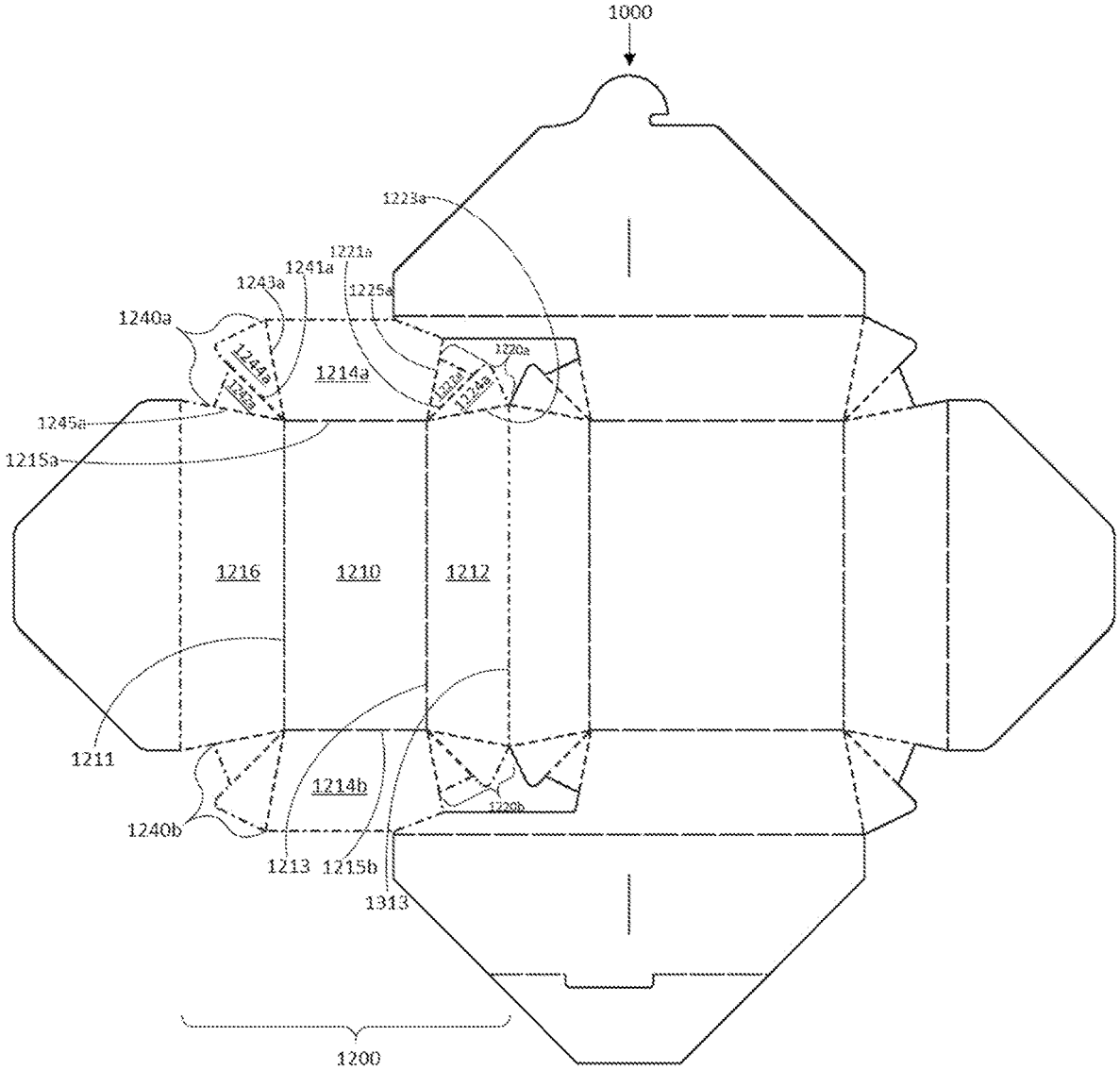
Figure 1D:
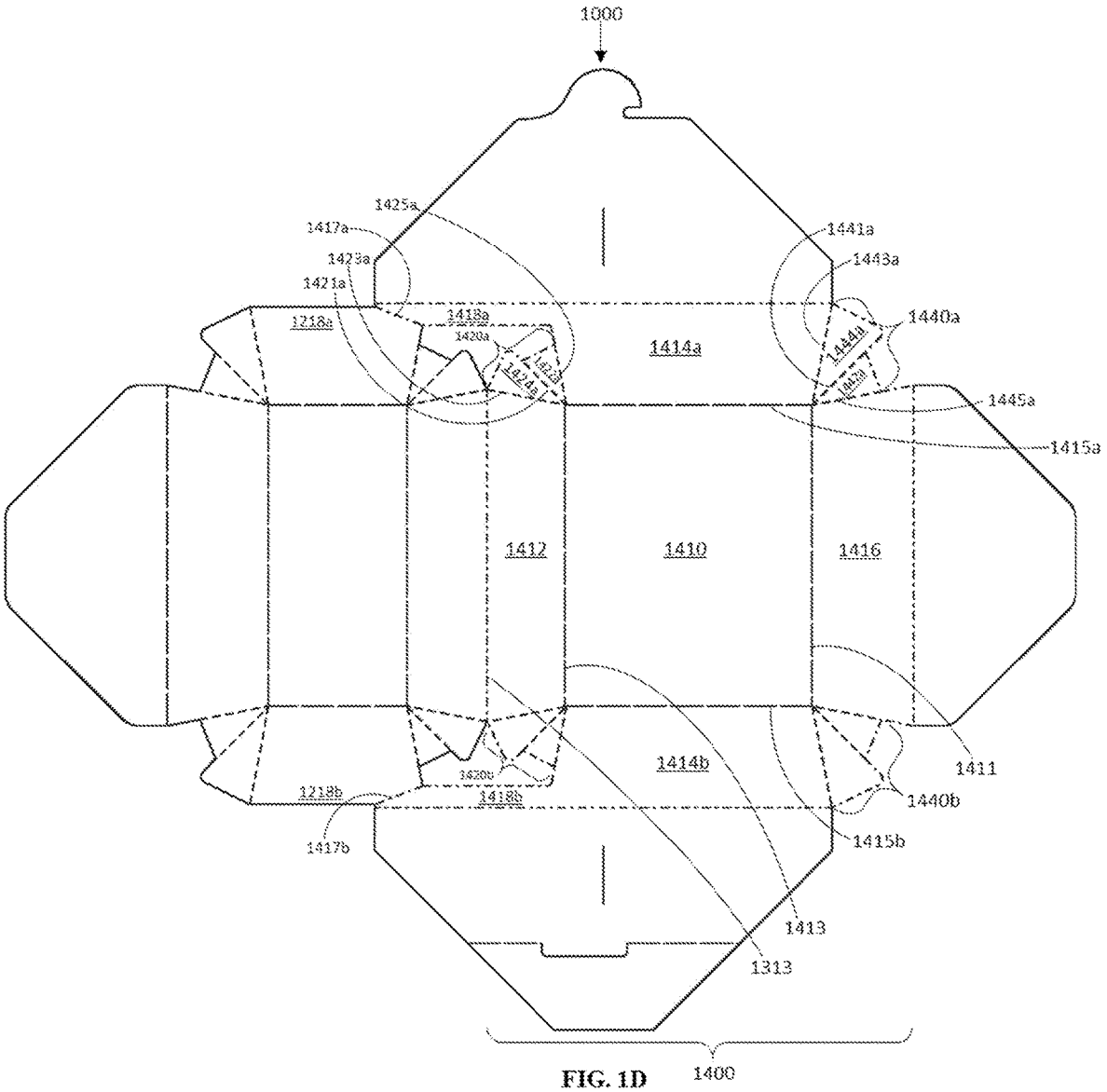

For example, as shown in FIG. 1D, the opposing side tray panels 1414*a* and 1414*b* contain extension portions 1418*a* and 1418*b*, respectively, on the opposite ends of the opposing side tray panels that connect to the third side tray panel 1416. Each of the extension portions 1418*a* and 1418*b* extends toward its adjacent side tray panel, which corresponds with one of the opposing side tray panels of the other tray portion (i.e. its corresponding opposing side tray panel 1214*a* or 1214*b*, respectively). Each of the extension portions 1418*a* and 1418*b* is separated from its corresponding opposing side tray panel 1214*a* or 1214*b* via a cut line 1417*a* or 1417*b*. The cut line defines the shape of an extension contacting portion 1218*a* or 1218*b* of the corresponding opposing side tray panel. The largest length ($L_1$) of the extension portion can be equal to or approximately equal to, or different from the largest length ($L_2$) of the corresponding opposing side tray panel. Typically, as shown in FIG. 3E, the largest length ($L_1$) of the extension portion 1418*a* and 1418*b* is the same as or similar to the largest length ($L_2$) of the corresponding opposing side tray panel 1214*a* and 1214*b*. Optionally, the blank shown in FIG. 3E can be modified such that the largest length of the extension portion is less than the largest length of the corresponding opposing tray. For example, instead of the cut line 1417*b* separating the extension portion from its corresponding opposing side tray panel, a second cut line would be present, which reduces the length of the extension portion (not shown in Figures). Thus a gap would form between the second cut line and the first cut line 1417*b*, and each of flap portions 1110 and 1120 would extend beyond the length of the extension portion.

When the paperboard blank is folded and the container is assembled, an exterior surface of each extension portion contacts and adheres to an extension contacting portion of the interior surface of its corresponding opposing side tray panel in the container.

For example, as illustrated in FIG. 3A-3D, when the opposing side tray panel 1414*b* is folded, the exterior surface 2418*b* of the extension portion (not shown in FIGS. 3A-3D, this surface is on the opposite surface of 1418*b*; see FIG. 2C) aligns with and adheres to an extension contacting portion 1218*b* of the interior surface 1214*b* of its corresponding opposing side tray panel. In this manner, when aligned and adhered, the interior surface 1418*b* of the extension portion is exposed to the interior of the compartment of the container. In this manner, when the container is assembled as illustrated in FIG. 5B, each of the extension portions 1418*a* and 1418*b* adheres to the extension contacting portion (1218*a* and 1218*b*, respectively) of the interior surface of its corresponding opposing side tray panel (1214*a* and 1214*b*, respectively).

Alternatively, in embodiments in which the container does not need to be leak resistant, when the paperboard blank is folded and the container is assembled, an interior surface of one or more of the extension portions, optionally each extension portion, may align with and contact an extension contacting portion of the exterior surface of its corresponding opposing side tray panel in the container (see, e.g. FIG. 10, extension portion 2418*b* and FIG. 11, extension portion 2418"b).

Optionally, both compartments in the container contain an extension portion on one or both of its opposing sidewalls. For example, as shown in FIGS. 9A and 9B, each tray portion contains extension portions on each of the opposing sidewall panels. In the first tray portion 1200', the opposing side tray panels 1214'*a* and 1214'*b* contain first extension portions 1219*a* and 1219*b*, respectively. Each extension portion is located on one end of the opposing side tray panel such that it substantially aligns with a partition panel 1212' in the first tray portion. Each of the first extension portions 1219*a* and 1219*b* extends toward its adjacent side tray panel, which corresponds with one of the opposing side tray panels of the other tray portion, i.e. the second tray portion 1400' (i.e. its corresponding opposing side tray panel 1414'*a* or 1414'*b*, respectively). Similarly, the corresponding opposing side tray panels 1414'*a* and 1414'*b* located in the second tray portion 1400' contain second extension portions 1418'*a* and 1418'*b*, respectively. Each extension portion is located on one end of the corresponding opposing side tray panel such that it substantially aligns with a partition panel 1412' in the second tray portion. Each of the extension portions 1418'*a* and 1418'*b* extends toward its adjacent side tray panel, 1214'*a* or 1214'*b*. Thus each set of adjacent sidewalls contains a set of extension portions containing a first extension portion in the first tray portion and a second extension portion in the second tray portion.

Each of flap portions 1110' and 1120' extend beyond the length of the second extension portion in the set of extension portions and are separated from the first extension portion in the set via a cut line 1419*a* or 1419*b*, respectively. Each of the extension portions 1219*a* and 1219*b* is separated from its corresponding opposing side tray panel 1414'*a* or 1414'*b* via a cut line 1417'*a* or 1417'*b*.

The largest length ($L'_{1a}$) of the first extension portion can be equal to or approximately equal to, or different from the largest length ($L'_{1b}$) of the second extension portion. For example, as shown in FIG. 9A, the length ($L'_{1a}$) of the first extension portion 1219*a* (or 1219*b*) is equal to or approximately equal to the length ($L'_{1b}$) of the second extension portion 1418'*a* (or 1418'*b*). As illustrated in FIG. 9A, cut lines 1417'*a* and 1419*a* meet at a first corner 1570'*a*. The length ($L'_{1a}$) of the first extension portion 1219*a* is measured from a first imaginary measuring line that is perpendicular to cut line 1419*a* and runs through the first corner 1570'*a* to a second imaginary measuring line that overlaps with cut line 1114'*a*, which defines an outer boundary of the flap portion 1110'. Cut lines 1341'*a* and 1343'*a* meet at a second corner 1540'*a*. The length ($L'_{1b}$) of the second extension portion 1418'*a* is measured from the first imaginary measuring line that is perpendicular to cut line 1419*a* and runs through the first corner 1570'*a* to a third imaginary measuring line that is perpendicular to cut line 1341'*a* and runs through the second corner 1540'*a*. Optionally, the largest lengths of the first extension portion and second extension portion can be different (i.e. $L'_{1a}$ can be different from $L'_{1b}$) (not shown in Figures). For example, in such embodiments, the cut line 1417'*a* could be located closer to side tray panel 1214'*a* and thus meet cut line 1419*a* at a corner that is closer to the side tray panel 1214'*a* compared to the location of the first corner 1570'*a* shown in FIG. 9A. In such embodiments, $L'_{1a}$ is shorter than $L'_{1b}$. Alternatively, cut line 1417'*a* could be located closer to side tray panel 1414'*a* and thus meet cut line 1419*a* and fold line 1115' at a corner that is closer to the side tray panel 1414'*a* compared to the location of the first corner 1570'*a* shown in FIG. 9A. In such embodiments, $L'_{1a}$ is longer than $L'_{1b}$. Typically, the total length ($L'_1$) of a set of extension portions, i.e. the sum of the length ($L'_{1a}$) of the first extension portion and the length ($L'_{1b}$) of the second extension portion is equal to or approximately equal to the length ($L'_2$) of the opposing side tray panel that is not attached to the flap portion. For example, as shown in FIG. 9B, the total length ($L'_1$), i.e. the sum of the length ($L'_{1a}$) of the first extension portion 1219*a* and the length ($L'_{1b}$) of the second extension portion 1418'*a* (or the sum of the length of the first extension portion 1219*b* and the length of the second extension portion 1418'*b*) is equal to or approximately equal to the length ($L'_2$) of the corresponding opposing side tray panel 1214'*a* (or 1214'*b*). The total length $L'_1$ is measured from the second imaginary measuring line that overlaps with cut line 1114'*a* to the third imaginary measuring line that is perpendicular to cut line 1341'*a* and runs through the second corner 1540'*a*. Cut lines 1217'*a* and 1247'*a* and fold line 1243'*a* meet at a third corner 1550'*a*, and cut lines 1341'*a* and 1323'*a* meet at a fourth corner 1520'*a*. The length ($L'_2$) of the opposing side tray panel 1214'*a* is measured from a fourth imaginary measuring line that is perpendicular to cut line 1217'*a* and runs through the third corner 1550'*a* to a fifth imaginary measuring line that is perpendicular to cut line 1341'*a* and runs through the fourth corner 1520'*a*.

Optionally, $L'_1$ can be shorter than $L'_2$ (not shown in the Figures). For example, in such embodiments, instead of being separated by a single cut line, two cut lines are included in the blank to define the ends of each of the first and second extension portions. For example, a first cut line defines the end of the first extension portion and a second cut line defines the end of the second extension portion, such that an open space (a gap) is created in between the first and second extension portions. In such embodiments, the total length $L'_1$ of a set of extension portions is the sum of the length ($L'_{1a}$) of the first extension portion, the length ($L'_{1b}$) of the second extension portion, excluding the length of the gap between the first and second extension portions. In these embodiments, the total length ($L'_1$) of the extension portions is less than the length of the length ($L'_2$) of the corresponding opposing side tray panel 1214'*a* (or 1214'*b*).

In embodiments where both compartments contain an extension portion on an opposing sidewall (i.e. contain a set of extension portions), one extension portion in the set is attached to an exterior surface of the corresponding opposing sidewall, while the other extension portion in the set is attached to an interior surface of the corresponding opposing sidewall. In some embodiments, an exterior surface the first extension portion of the set of extension portions contacts and adheres to an interior surface of its corresponding opposing sidewall; and an interior surface of the second extension portion of the set contacts and adheres to an exterior surface of its corresponding opposing sidewall. In other embodiments, an exterior surface of the second extension portion of the second compartment contacts and adheres to an interior surface of its corresponding opposing sidewall; and an interior surface of the first extension portion of the first compartment contacts and adheres to an exterior surface of its corresponding opposing sidewall. When both opposing sidewalls in the container each contain a set of extension portions, the extension portions can adhere to each opposing sidewall in the same or different arrangements.

b. Partition Panels

The partition panels of the first tray portion and the second tray portion are connected via the central fold line. Each of the opposite ends of each partition panel is in contact with a set of gusset panels via a fold line. Each partition panel extends outwardly from the corresponding bottom tray panel and folds along the central fold line.

When the first and second tray portions are assembled into first and second compartments in a container, each partition panel is located at an angle equal to or greater than 90° relative to the adjacent bottom panel and the two partition panels form an inverted V-shaped internal partition. The resulting internal partition separates the first and second compartments in the container.

For each tray portion, as the partition panel folds, the adjacent set of gusset panels folds inwardly along the dividing fold line, such that an exterior surface of the first gusset panel contacts an exterior surface of the second gusset panel and an interior surface of either one or both of the first and second gusset panels contacts a gusset contacting portion of the interior surface of the adjacent side tray panel (i.e. one of the opposing side tray panels) of the same tray portion or the partition wall.

2. Flap Portions

The four flap portions form the closure flaps when the blank is assembled into a container. Each of two opposing flap portions is connected to a third side tray panel of the first or the second tray portion via a fold line (referred to as the left and right flap portions, respectively), and each of the other two opposing flap portions is connected to one opposing side tray panel that contains an extension portion via a fold line (referred to as the front and rear flap portions, respectively).

For example, the first flap portion is hingedly connected to the third side tray panel of the first tray portion via a first fold line; the second flap portion is hingedly connected to the third side tray panel of the second tray portion via a second fold line; the third flap portion is hingedly connected to a first opposing side tray panel that contains the extension portion via a third fold line; and the fourth flap portion is hingedly connected to a second opposing side tray panel that contains the extension portion via a fourth fold line. The first and the second opposing side tray panels that contain the extension portions are located on opposing sides of the same tray portion.

The fold lines between the flap portions and each side tray panel form the top edges of the first and second compartments when the blank is assembled into a container.

When both the first and second tray portions contain opposing side tray panels that contain extension portions, each of the front and rear flap portions may be connected to either the opposing side tray panel of the first tray portion or the opposing side tray panel of the second tray portion.

In some embodiments, when assembled, one or more of the closure flaps may be removable from the top edge of its connected sidewall. In such embodiments, one or more top edges of the container are perforated to facilitate removal of the closure flap(s) from the container (see, e.g. FIG. 8, 3115", 3125", 3135", and 3145"). Alternatively, one or more top edges can be scored, laser cut, embossed, or weakened to facilitate the removal of the closure flap(s) from the container, such as by a user pulling on the closure flap(s).

Optionally, one or more of the flap portions contains one or more cut lines configured to form relief cuts to release heat from a closed container that contains hot food or slits to receive utensils when the container is assembled.

a. Tab and Slit

One of the four flap portions may contain a tab, and its opposing flap portion may contain a slit, which corresponds to the size and shape of the corresponding tab. The tab can have any suitable size and shape that is configured to fit inside the corresponding slit on the opposing flap portion. Suitable shapes for the tab include, but are not limited to, a hook tab, such as a right hook tab, a left hook tab, or a double hook tab, and a tuck tab. An exemplary hook is shown in FIG. 1A. The slit can be a single cut line having a suitable shape and size to receive the corresponding tab, such as a curved cut line (convex or concave), a straight cut line, or other suitable shapes to receive the corresponding tab. Optionally, one or more additional cut lines are arranged perpendicularly to the slit, such as located on each side of the slit, in the middle of the slit, or on each side and the middle of the slit. For example, as shown in FIG. 1A, the slit is a single straight cut line with curved edges; two additional cut lines are perpendicular to and located on each side of the slit. The additional cut lines are configured to facilitate removal of the tabs from the slit.

As the two compartments are formed, each of the four closure flaps moves from a substantially upright position when in the open position and folds inwardly and downwardly into a position above and substantially parallel with the bottom tray panels to close the container. The closure flaps can secure the closed container in a closed and locked position by inserting the tab into the slit.

The flap portion containing the slit may include fold line(s), which allows a container to be filled such that its flap closures bulges, yet the container can be secured in the closed and locked positon, such as one described above.

EXAMPLES

A. Two-Compartment Container with Rectangular Tray

Figure 5A:
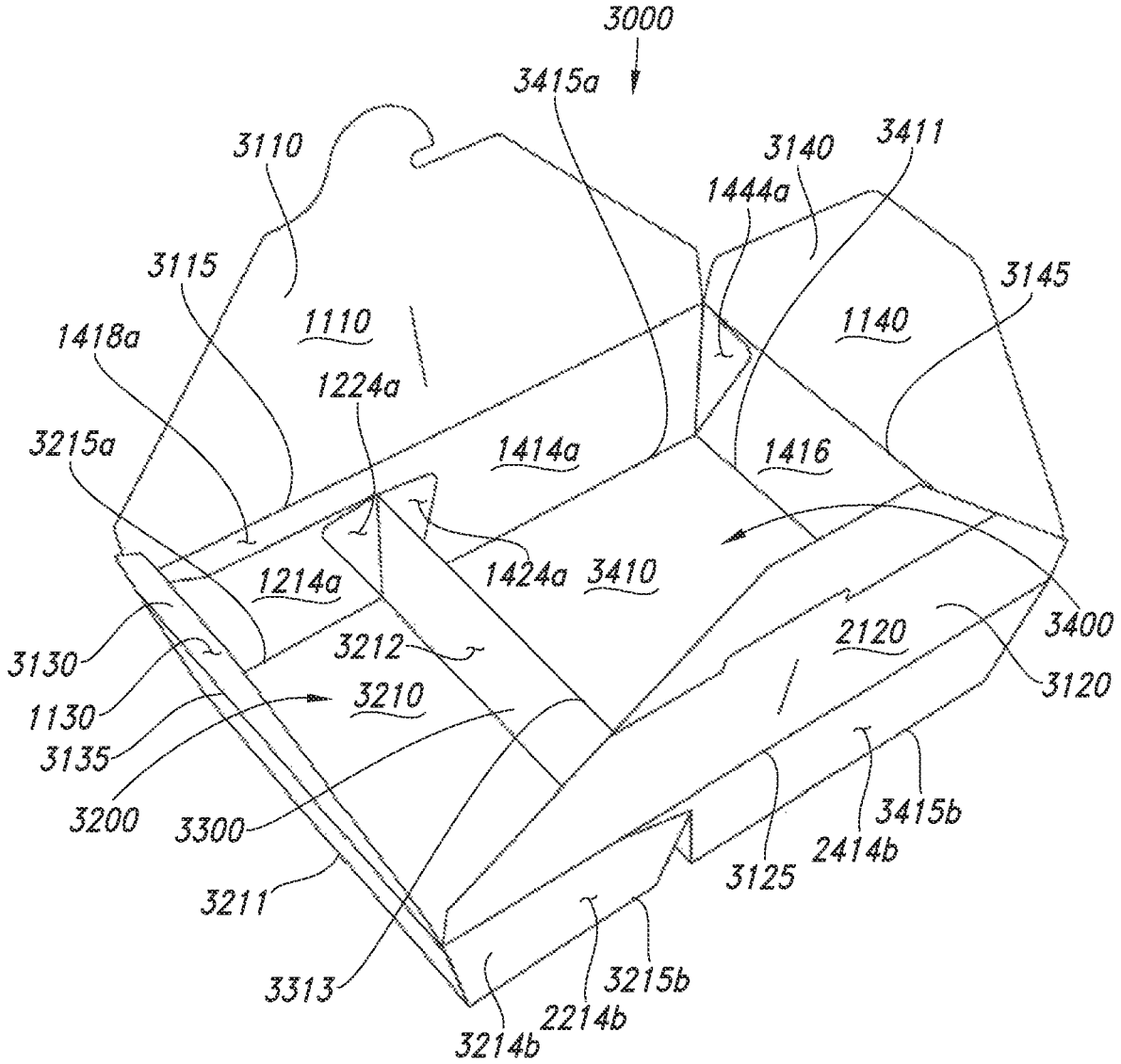
FIGS. 5A-5C are three views of the two-compartment container that forms when the blank depicted in FIGS. 1A-1D and 2A-2C is assembled.
Figure 5B:
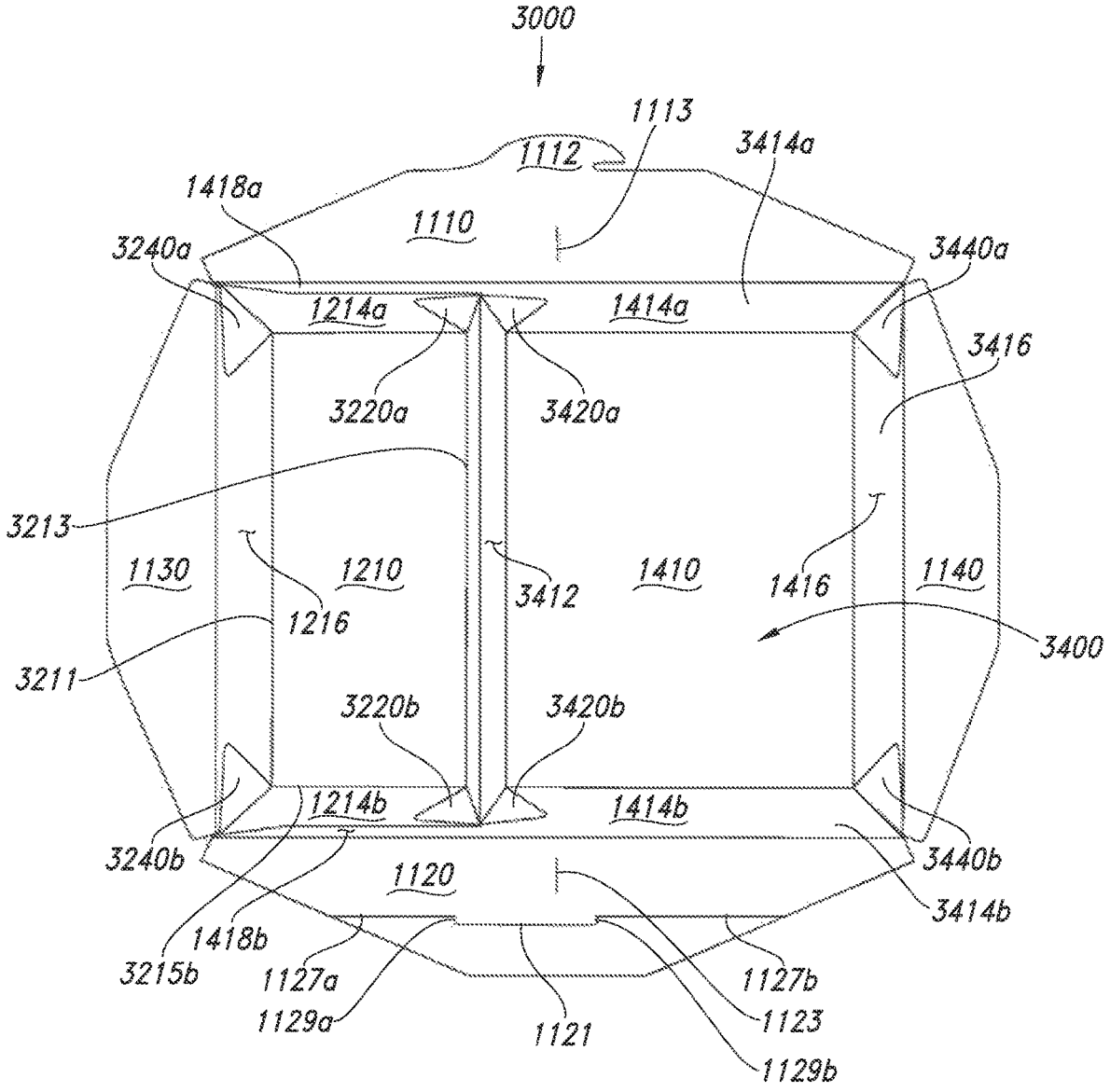
Figure 5C:
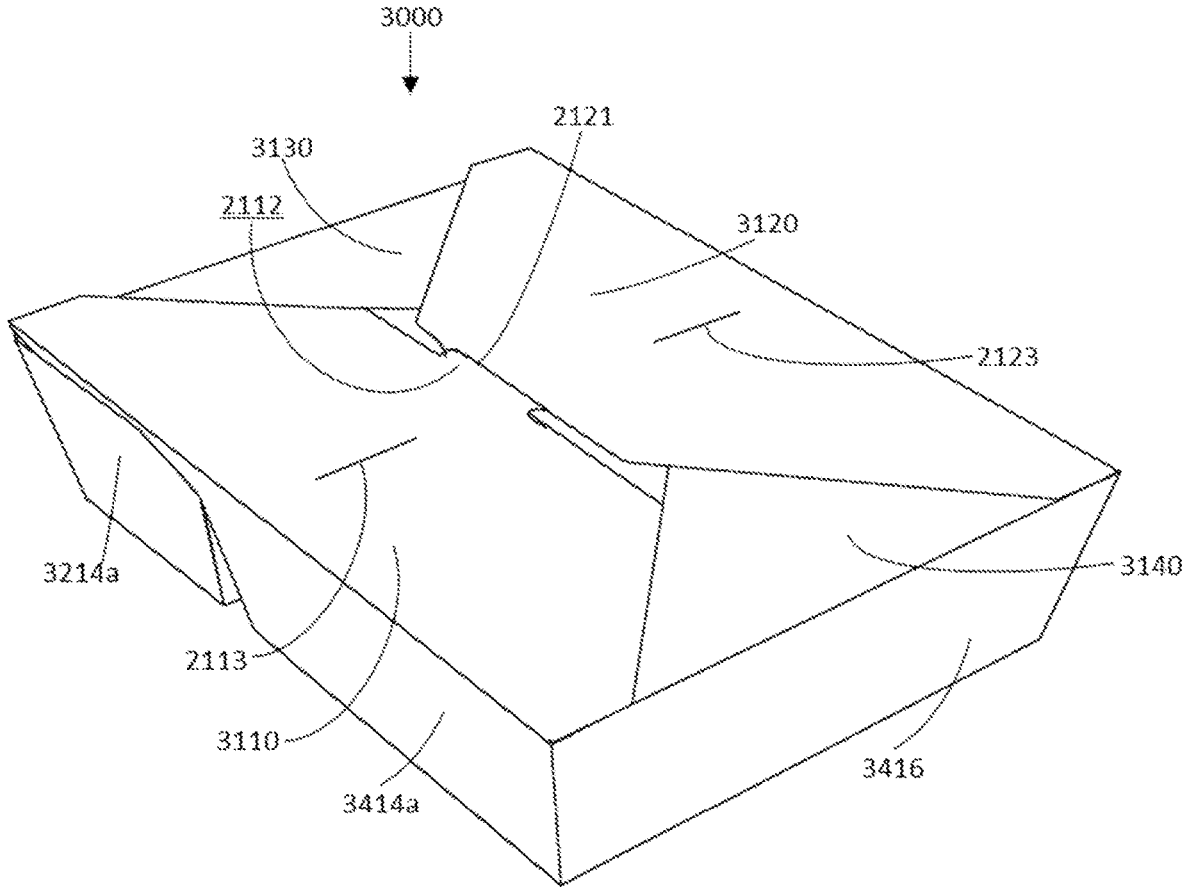

FIGS. 1A-1D and 2A-2C illustrate a plan view of an exemplary blank that may be used to form an exemplary two-compartment container with a rectangular tray and four closure flaps, such as container 3000 illustrated in FIGS. 5A-5C.

Figure 2A:
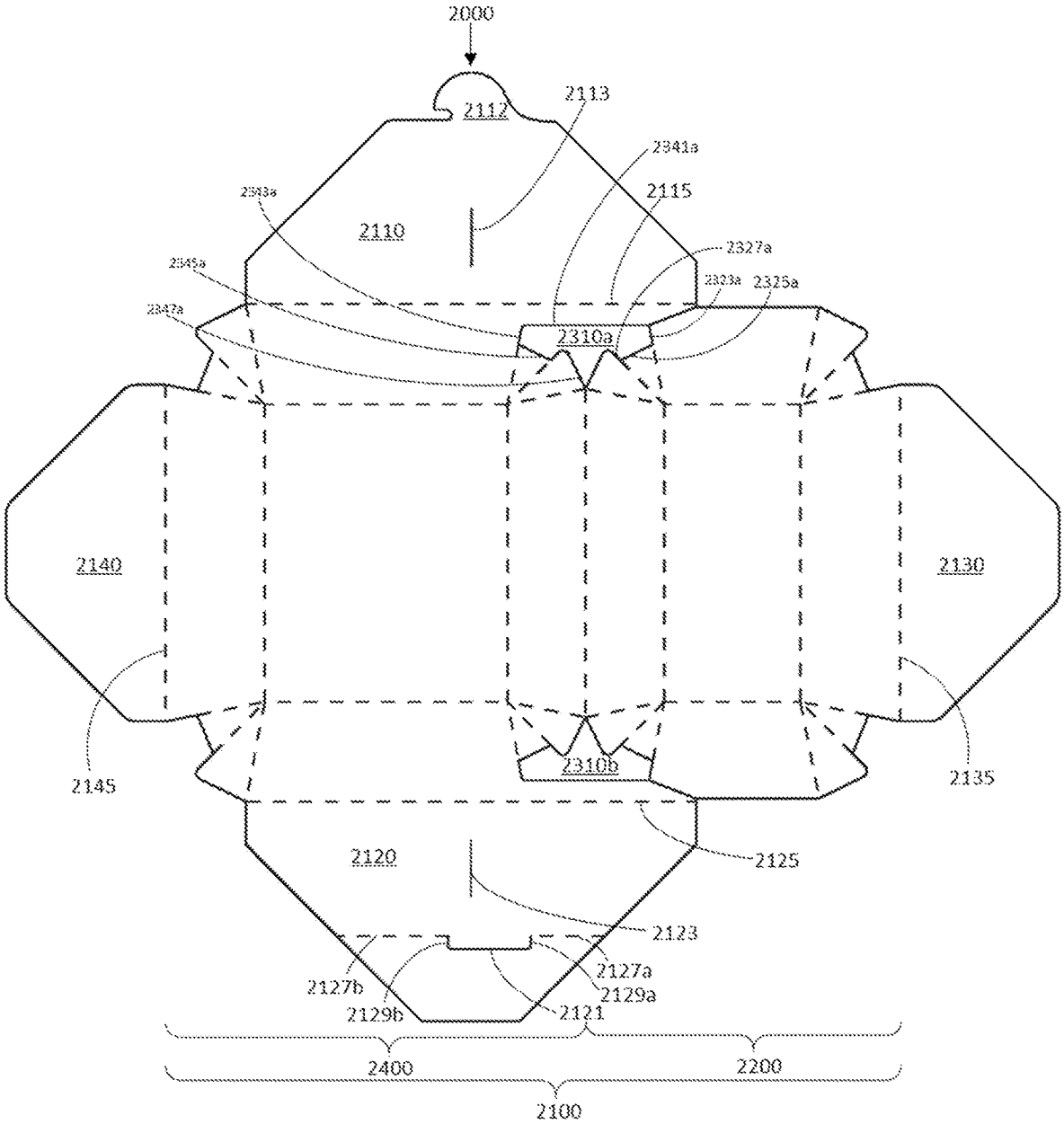
FIGS. 2A-2C are plan views of the exterior surface of the exemplary blank depicted in FIGS. 1A-1D.
Figure 2B:
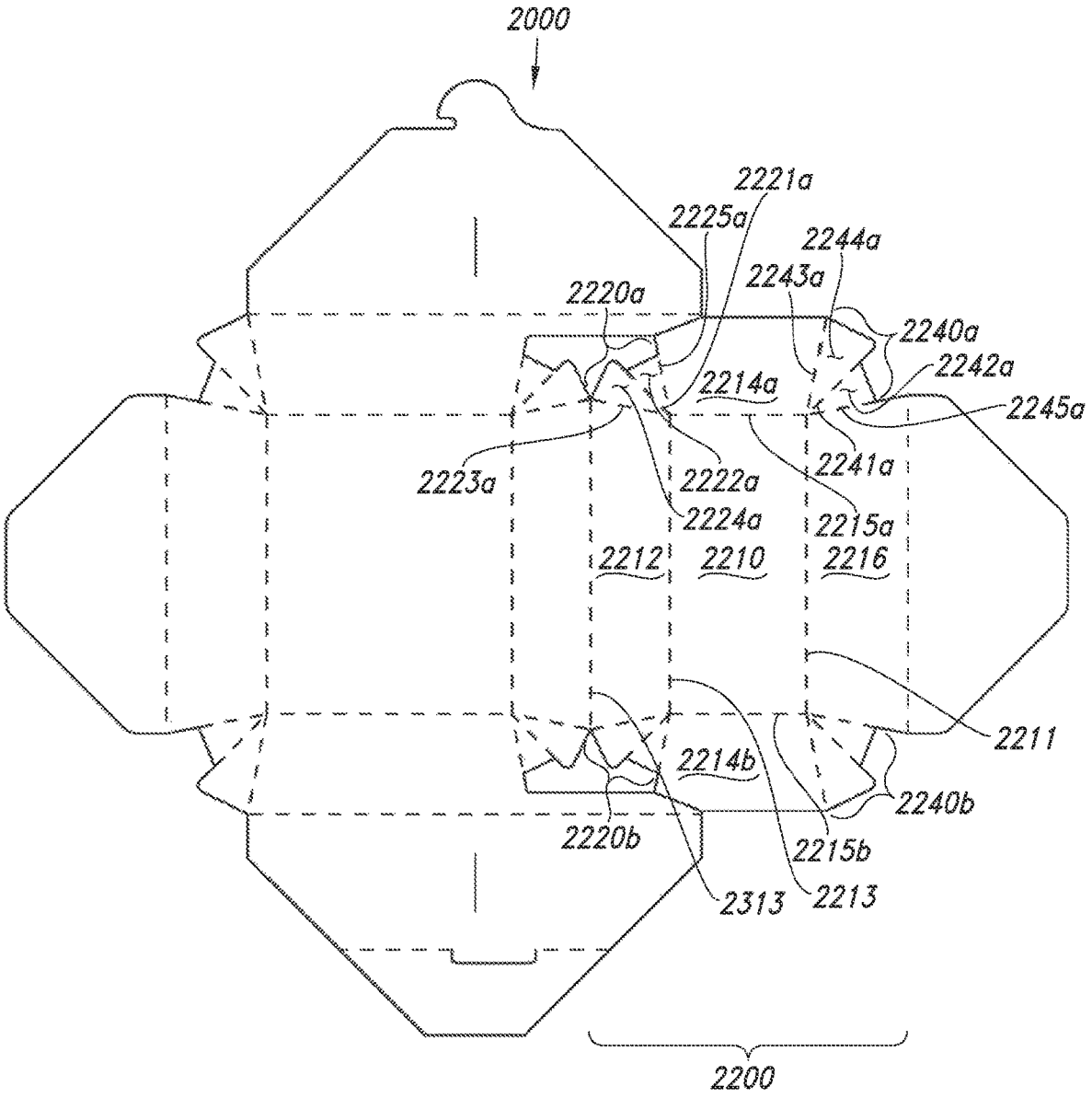
Figure 2C:
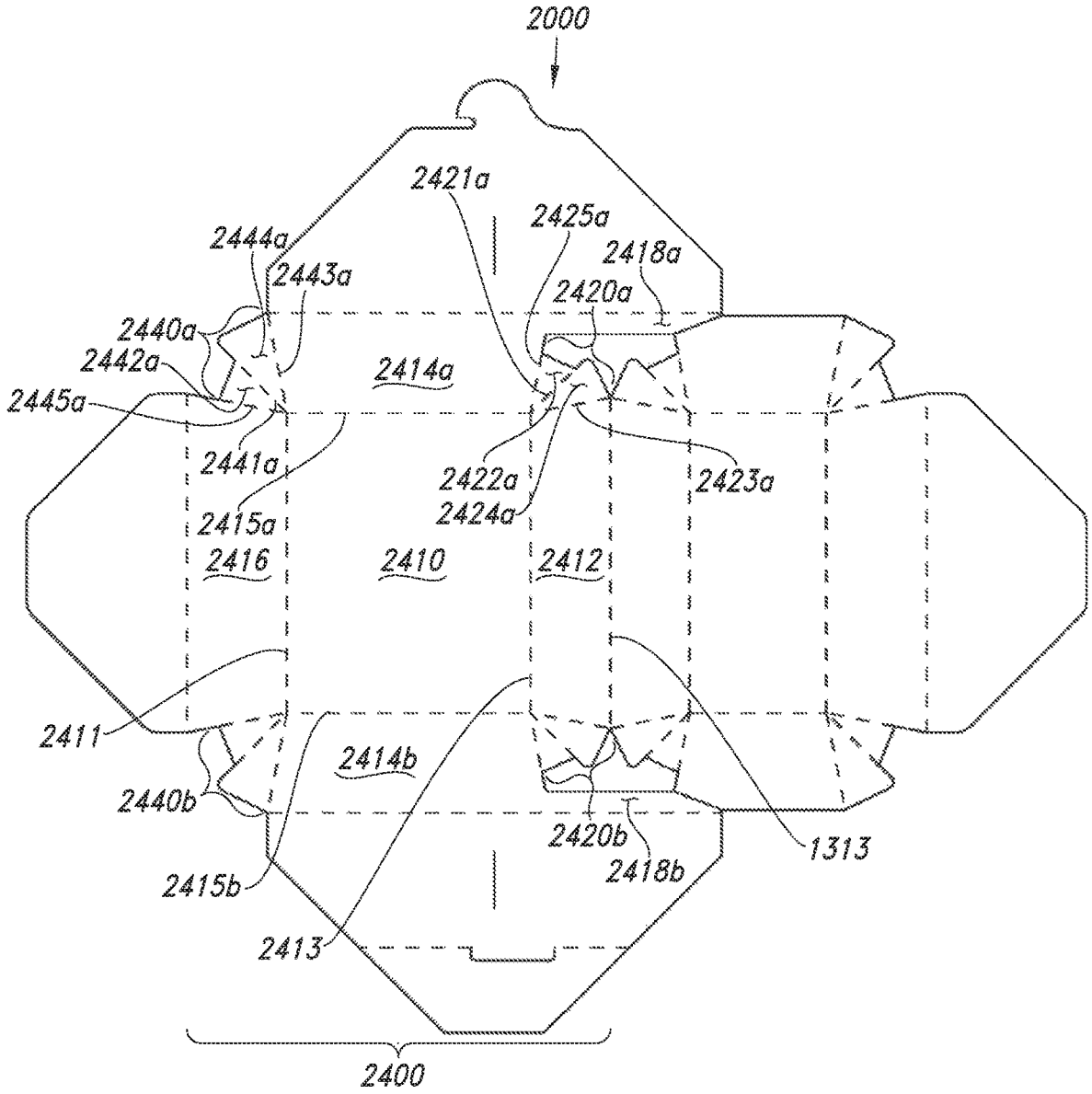

The exemplary paperboard blank forming the container 3000 has an interior surface 1000, illustrated in FIGS. 1A-1D and an exterior surface 2000, illustrated in FIGS. 2A-2C. When the blank is assembled to form the container 3000, the interior surface 1000 forms two compartments, such as 3200 and 3400 in FIG. 5A, into which materials, such as food items, can be placed.

The interior surface 1000 of the paperboard blank contains a central polygonal bottom panel (referred to as the tray portion 1100), which forms the two compartments of the tray when it is assembled into a container, and four polygonal top panels (referred to as the flap portions 1110, 1120, 1130, and 1140), which form the closure flaps, such as 3110, 3120, 3130, and 3140 in FIG. 5A, when the blank is assembled into a container. Each of the four flap portions is connected to the tray portion via a fold line 1115, 1125, 1135, or 1145.

In FIG. 1A, the dashed lines indicate fold lines and the solid lines indicate cut lines of the blank. These fold lines and cut lines apply to FIGS. 1B-1D. The cut lines define the outer boundaries of the side tray panels, gussets, and flap portions. FIGS. 1B-1D also include dash-dotted lines to indicate boundaries of the tray portion 1100, first tray portion 1200, and second tray portion 1400, respectively.

The descriptions with respect to the interior surface 1000 of the blank generally apply to the exterior surface 2000 of the blank illustrated in FIGS. 2A-2C. The reference numbers on the exterior surface 2000 generally correspond to the reference numbers on the interior surface 1000, however, they start with a "2" instead of "1" to indicate the exterior surface of the same element, e.g. interior surface of the bottom panel 1100 in FIG. 1A corresponds with exterior surface of the bottom panel 2100 in FIG. 2A.

The tray portion 1100 includes a first polygonal panel (referred to as the first tray portion 1200), which forms the first compartment, such as 3200 in FIG. 5A, of the tray when it is assembled, a second polygonal panel (referred to as the second tray portion 1400), which forms the second compartment, such as 3400 in FIG. 5A, of the tray when it is assembled, and two polygonal panels connecting the first tray portion and the second tray portion (referred to as the cut-out portions 1310*a* and 1310*b*), which are removed when the compartments of the tray are formed.

As shown in FIG. 1C, the first tray portion 1200 includes a bottom tray panel 1210, three side tray panels 1214*a*, 1214*b*, and 1216, four sets of gusset panels 1220*a*, 1220*b*, 1240*a*, and 1240*b*, and an interior partition panel 1212; each of the side tray panels and the interior partition panel is connected to one side of the bottom tray panel via a fold line 1215*a*, 1215*b*, 1211, or 1213.

The fold lines between the bottom tray panel and each side tray panel or the interior partition panel form the bottom edges of the first compartment when the blank is assembled into a container, such as bottom edges 3215*a*, 3215*b*, 3211, and 3213 of the first compartment 3200 in FIGS. 5A and 5B.

Two side tray panels are located at the opposite sides of the bottom tray panel 1210 (referred to as the opposing side tray panels 1214*a* and 1214*b*) and the third side tray panel 1216 and the partition panel 1212 are located on a second set of opposite sides of the bottom tray panel. The third side tray panel 1216 is located between each of the opposing side tray panels 1214*a* and 1214*b* and is connected to each opposing side tray panel via a set of two gusset panels 1240*a* or 1240*b*. Similarly, each of the opposing side tray panels is located between the third side tray panel 1216 and the partition panel 1212 and is connected to the third side tray panel via a set of two gusset panels 1240*a* or 1240*b* and to the partition panel via a set of two gusset panels 1220*a* or 1220*b*.

A set of gusset panels 1240*a* is connected to the third side tray panel 1216 via a fold line 1245*a* and to the opposing side tray panel 1214*a* via a fold line 1243*a*; a first gusset panel 1242*a* is connected to a second gusset panel 1244*a* via a dividing fold line 1241*a*. The dividing fold line 1241*a* divides the set of gusset panels 1240*a* into a first gusset panel 1242*a* and a second gusset panel 1244*a*. The set of gusset panels 1240*b* is connected to the third tray panel 1216 and to the opposing side tray panel 1214*b* in the same manner. Similarly, a set of gusset panels 1220*a* is connected to the opposing side tray panel 1214*a* via a fold line 1225*a* and to the partition panel 1212 via a fold line 1223*a*; a first gusset panel 1222*a* is connected to a second gusset panel 1224*a* via a dividing fold line 1221*a*. The dividing fold line 1221*a* divides the set of gusset panels 1220*a* into a first gusset panel 1222*a* and a second gusset panel 1224*a*. The set of gusset panels 1220*b* is connected to the third tray panel 1214*b* and to the partition panel 1212 in the same manner.

The descriptions with respect to the first tray portion 1200 generally apply to the second tray portion 1400 of the blank illustrated in FIG. 1D. The reference numbers on the second tray portion 1400 generally correspond to the reference numbers on the first tray portion 1200, however, the first two digits are "14" instead of "12", e.g. the partition panel is 1212 in FIG. 1C and the partition panel is 1412 in FIG. 1D.

A few differences between the first tray portion and the second tray portion are described below.

As shown in FIG. 1D, the second bottom tray panel 1410 has a width that is larger than the first bottom tray panel 1210. Although not illustrated in FIGS. 1A-1D and 2A-2C, the second bottom tray panel may have the same dimensions as the first bottom tray panel and/or is in a different shape, such a square, a triangle, or the shape of other polygons.

Additionally, as shown in FIG. 1D, the opposing side tray panels 1414*a* and 1414*b* contain extension portions 1418*a* and 1418*b*, respectively, on the opposite ends of the opposing side tray panels that connect to the third side tray panel 1416. Each of the extension portions 1418*a* and 1418*b* extends toward its adjacent side tray panel, which corresponds with one of the opposing side tray panels of the first tray portion (i.e. the corresponding opposing side tray panel 1214*a* and 1214*b*, respectively). Each of the extension portions 1418*a* and 1418*b* is separated from its corresponding opposing side tray panel 1214*a* or 1214*b* via a cut line 1417*a* or 1417*b*. The cut line defines the shape of an extension contacting portion 1218*a* or 1218*b* of the corresponding opposing side tray panel. Typically, as shown in FIG. 3E, the largest length ($L_1$) of the extension portion 1418*a* and 1418*b* is the same as or similar to the largest length ($L_2$) of the corresponding opposing side tray panel 1214*a* and 1214*b*.

The partition panels of the first tray portion and the second tray portion, 1212 and 1412, are connected via a central fold line 1313. Although not shown in FIGS. 1A-1D, the partition panels 1212 and 1412 can be located towards the center of the bottom tray portion 1100 (i.e. the central fold line 1313 would be located at or approximately at the center of the bottom tray portion 1100), such that the first bottom tray portion 1200 has a size that is equal to or approximately equal to the second bottom tray portion 1400. As illustrated in FIG. 1C, the opposite ends of partition panel 1212 are in contact with two set of gusset panels 1220*a* and 1220*b*, via fold lines 1223*a* and 1223*b* respectively. Similarly, as illustrated in FIG. 1D, the opposite ends of partition panel 1412 are in contact with two set of gusset panels 1420*a* and 1420*b*, via fold lines 1423*a* and 1423*b* respectively.

As illustrated in FIG. 1B, a cut-out portion 1310*a* is located between the second opposing side tray panel 1414*a* and its corresponding first opposing side tray panel 1214*a*. The cut-out portion 1310*a* is defined by cut lines 1341*a*, 1343*a*, 1323*a*, 1325*a*, 1327*a*, 1347*a*, and 1345*a*. The cut-out portion 1310*a* forms an open region that separates the opposing first side tray panel 1214*a* and gusset panels 1222*a* and 1224*a* in the first tray panel 1200 from the second opposing side tray panel 1414*a* and gusset panels 1422*a* and 1424*a*. Similarly, as shown in FIG. 1B, a cut-out portion 1310*b* is located between the second opposing side tray panel 1414*b* and its corresponding first opposing side tray panel 1214*b*. The cut-out portion 1310*b* forms an open region that separates the opposing side tray panel 1214*b* and gusset panels 1222*b* and 1224*b* in the first tray panel 1200 from the opposing side tray panel 1414*b* and gusset panels 1422*b* and 1424*b*.

Generally, the two cut-out portions 1310*a* and 1310*b* are cut out of or removed from the blank prior to assembling the container.

In the first tray portion 1200 of the resulting container 3000, the side tray panels 1214*a*, 1214*b*, 1216, extend outwardly from the bottom panel 1210, such that they are angled away from 1210 at an angle equal to or greater than 90° when the tray is assembled into a container 3000, as illustrated in FIG. 5A. As the side tray panels fold, each set of gusset panels 1220*a*, 1220*b*, 1240*a*, and 1240*b* folds inwardly along its dividing fold line, such that an interior surface of the first gusset panel and an exterior surface of the second gusset panel contacts a gusset contacting portion of the interior surface of the adjacent side tray panel (either an opposing side tray panel or the third side tray panel).

FIGS. 3A-3D show the interior surfaces of the gusset panels when they are folded to form folded gussets 3220*b* and 3420*b* in FIG. 5B. As illustrated in FIG. 3A, the first gusset panel 1222*b* has a shape and/or size that is different from the second gusset panel 1224*b*, and the overall size of the first gusset panel 1222*b* is smaller than the second gusset panel 1224*b*. As illustrated in FIGS. 3B and 3C, when folded, the interior surface 1222*b* of the first gusset panel contacts and attaches to a gusset contacting portion 1228*b* of the interior surface of the adjacent opposing sidewall 1214*b*. FIG. 4 shows the exterior surfaces 2222*a* and 2224*a* of a set of gusset panels when they are partially folded to form folded gusset 3220*a* in FIG. 5B. As illustrated in FIG. 4, when folded, the exterior surface 2224*a* of the second gusset panel covers the exterior surface 2222*a* of the first gusset panel. The exterior surface of the portion 2226*a* of the second gusset panel that is larger than the first gusset panel contacts and adheres to a gusset contacting portion of the interior surface of the adjacent opposing sidewall 1214*a* (not visible in FIG. 4; this surface is on the opposite surface of 2214*a*; see FIG. 1C). In this manner, when folded, the interior surface 1224*a* of the second gusset panel is exposed to the interior of the compartment of the container, while the first gusset panel 1222*b* is covered by the second gusset panel. Similarly, as illustrated in FIG. 3D, when folded, the interior surface 1224*b* of the second gusset panel is exposed to the interior of the compartment of the container. In this manner, when the container is assembled, as illustrated in FIG. 5B, each of the folded gussets 3220*a*, 3220*b*, 3240*a*, and 3240*b* contacts and adheres to the gusset contacting portion of the interior surface of the adjacent opposing sidewall 1214*a* or 1214*b*, or the interior surface of the third sidewall 1216.

Similarly, in the second tray portion, the side tray panels 1414*a*, 1414*b*, and 1416, and the gussets 3420*a*, 3420*b*, 3440*a*, and 3440*b* shown in FIG. 5B, are folded and assembled in a similar manner to the first tray portion described above. Additionally, as illustrated in FIG. 3A-3D, when the opposing side tray panel 1414*b* is folded, the exterior surface 2418*b* of the extension portion (not shown in FIGS. 3A-3D, this surface is on the opposite surface of 1418*b*; see FIG. 2C) aligns with and adheres to an extension contacting portion 1218*b* of the interior surface 1214*b* of its corresponding opposing side tray panel in the container. In this manner, when aligned and adhered, the interior surface 1418*b* of the extension portion is exposed to the interior of the compartment of the container. In this manner, when the container is assembled, as illustrated in FIG. 5B, each of the extension portions 1418*a* and 1418*b* adheres to the extension contacting portion (1218*a* and 1218*b*, respectively) of the interior surface of its corresponding opposing side tray panel (1214*a* and 1214*b*, respectively).

When the first and second tray portions 1200 and 1400 are assembled into first and second compartments 3200 and 3400 respectively in container 3000, partition walls 3212 and 3412 extend outwardly from their respective adjacent bottom tray panel 1210 or 1410 and fold along the central fold line 1313, which forms the partition edge 3313. Each partition wall is located at an angle equal to or greater than 90° relative to the adjacent bottom panel and the two partition walls form an inverted V-shaped internal partition 3300, as illustrated in FIGS. 3C and 3D. The resulting internal partition 3300 separates the first and second compartments 3200 and 3400 in the container 3000, as illustrated in FIG. 5A.

Figure 8:
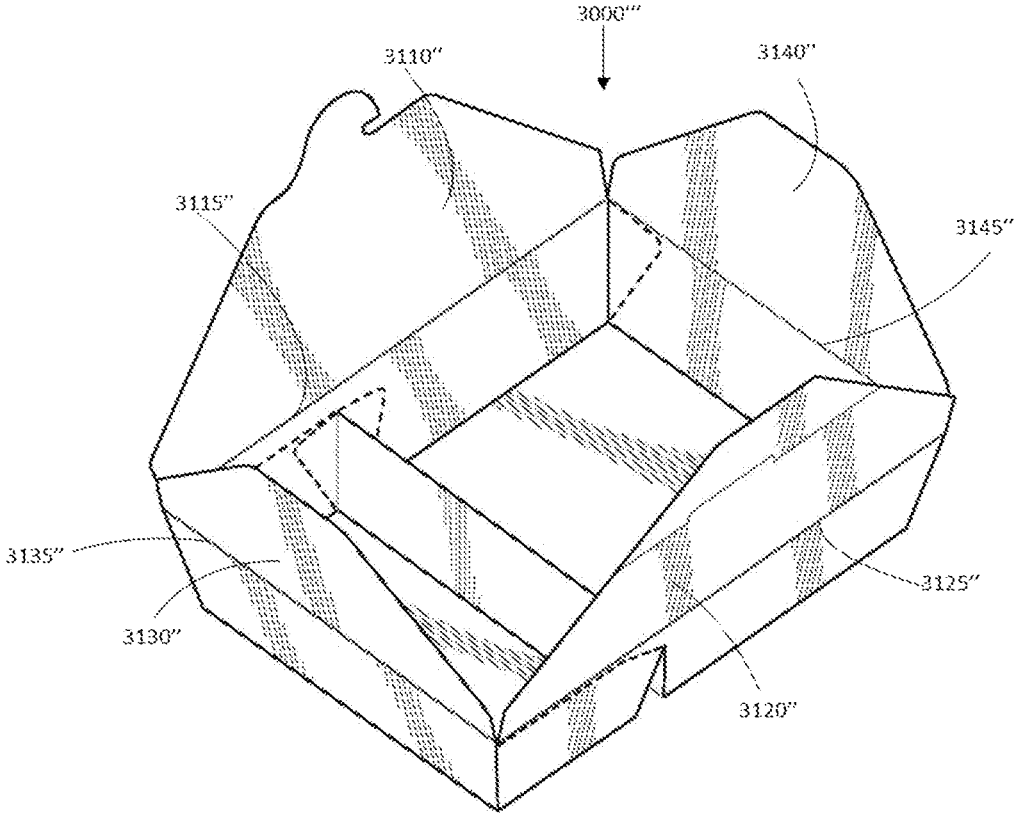
FIG. 8 depicts a top isometric view of a container with perforated top edges to facilitate removal of the closure flaps from the container (dashed lines indicate the boundaries of folded gussets or extension portion that adhere to and are on top of the interior surfaces of the sidewalls, or the boundary of the exterior surface of the sidewall that adheres to the extension portion of its corresponding opposing sidewall).

FIG. 1A shows four flap portions 1110, 1120, 1130, and 1140, which form the closure flaps 3110, 3120, 3130, and 3140 in FIG. 5A when the blank is assembled into container 3000. Left flap portion 1130 is connected to the third side tray panel 1216 of the first tray portion 1200 via a fold line 1135; right flap portion 1140 is connected to the third side tray panel 1416 of the second tray portion 1400 via a fold line 1145. Rear flap portion 1110 is connected to the opposing side tray panel 1414*a* via a fold line 1115; front flap portion 1120 is connected to the opposing side tray panel 1414*b* via a fold line 1125. Cut lines 1122*a*, 1122*b*, 1124*a*, 1124*b*, and 1128 define the outer boundaries of the front flap portion 1120. The fold lines 1115, 1125, 1135, and 1145 form the top edges 3115, 3125, 3135, and 3145 of the first and second compartments when the blank is assembled into a container 3000 (see FIG. 5A). In some embodiments, as illustrated in FIG. 8, when assembled, the top edges 3115", 3125", 3135", and 3145" of the container 3000" are perforated to facilitate removal of the closure flaps 3110", 3120", 3130", and 3140" from the container.

As shown in FIG. 1A, flap portion 1110 contains a tab 1112, and its opposing flap portion 1120 contains a slit 1121, which corresponds to the size and shape of the tab 1112. The tab 1112 has the shape of a hook, however, it can have any other suitable size and shape that is configured to fit inside the corresponding slit on the opposing flap portion. The slit 1121 is a single cut line with curved edges. Two additional cut lines 1129*a* and 1129*b* are perpendicular to and located on the opposite ends of the slit 1121. The additional cut lines 1129*a* and 1129*b* are configured to facilitate removal of the tabs 1112 from the slit 1121. Although not shown in FIG. 1A, the slit can have any other suitable size and shape as long as it can receive the corresponding tab or a portion of the corresponding tab.

As the two compartments 3200 and 3400 are formed, each of the four closure flaps 3110, 3120, 3130, and 3140 moves from a substantially upright position when in the open position, as illustrated in FIG. 5A, and folds inwardly and downwardly into a position above and substantially parallel with the bottom tray panels 1210 and 1410 to close the container 3000, as illustrated in FIG. 5C. When transferring from the open position to the closed position, typically the left and right closure flaps 3130 and 3140 are folded into a position that is substantially parallel with the bottom; and the front and rear closure flaps 3110 and 3120 are folded on top of the left and right flaps. The front and rear closure flaps secure the container 3000 in a closed and locked position by inserting the tab 2112 into the slit 2121.

As shown in FIG. 1A, flap portion 1120 includes two fold lines 1127*a* and 1127*b* that are aligned substantially parallel to the slit 1121; each fold line connects an end point of one perpendicular cut line 1129*a* or 1129*b*, and extends to one edge of the flap portion 1120. The fold lines 1127*a* and 1127*b* allow a container to be filled such that its flap closures bulges, yet the container can be secured in the closed and locked positon.

As shown in FIGS. 5A-5C, each of the flap portions 2110 and 2120 contains a slit 2113 or 2123. Slits 2113 and 2123 are relief cuts that allow for heat and steam to escape from the container, when the container is in the closed position and when a hot substance. Optionally, the slits are configured to receive utensils such as the handle portion of cutlery or a portion of chopsticks. Optionally, the container does not contain any relief cuts, such as container 3000' illustrated in FIGS. 6A-6C.

Those skilled in the art will recognize, or be able to ascertain using no more than routine experimentation, many equivalents to the specific embodiments of the invention described herein. Such equivalents are intended to be encompassed by the following claims.

We claim:

1. A blank forming a two-compartment container comprising:

a tray portion and four flap portions, wherein each of the four flap portions is connected to the tray portion via a fold line, wherein the tray portion comprises a first tray portion and a second tray portion, wherein the first tray portion is connected to the second tray portion via a central fold line, wherein each of the first and second tray portions includes a bottom tray panel, three side tray panels, four sets of gusset panels, and an interior partition panel, wherein each of the side tray panels and the interior partition panel is connected to one side of the bottom tray panel via a fold line, wherein in each of the first and second tray portions, the three side tray panels comprise two opposing side tray panels and a third side tray panel, wherein the opposing side tray panels are located on a first set of opposite sides of the bottom tray panel and the third side tray panel and the partition panel are located on a second set of opposite sides of the bottom tray panel, wherein each opposing side tray panel is connected to the third side tray panel via the first and the second sets of gusset panels and to the interior partition panel via the third and the fourth sets of gusset panels, and wherein in at least one of the first tray portion and the second tray portion each of the opposing side tray panels comprises an extension portion, wherein the extension portion extends toward the adjacent opposing side tray panel.

2. The blank of claim 1, wherein the bottom tray panel of the first tray portion has the same shape and/or size as the bottom tray panel of the second tray portion, or wherein the bottom tray panel of the first tray portion has a shape and/or size that is different from the bottom tray panel of the second tray portion.

3. The blank of claim 1, wherein each set of gusset panels comprises a first gusset panel and a second gusset panel, and wherein the first gusset panel is connected to the second gusset panel via a dividing fold line.

4. The blank of claim 3, wherein the first gusset panel has a shape and/or size that is different from the second gusset panel.

5. The blank of claim 1, wherein the largest length of the extension portion is the same as or similar to the largest length of the adjacent opposing side tray panel.

6. The blank of claim 1, wherein the first flap portion is hingedly connected to the third side tray panel of the first tray portion via a first fold line, wherein the second flap portion is hingedly connected to the third side tray panel of the second tray portion via a second fold line, wherein the third flap portion is hingedly connected to a first opposing side tray panel that contains the extension portion via a third fold line, and wherein the fourth flap portion is hingedly connected to a second opposing side tray panel that contains the extension portion via a fourth fold line, wherein the first and the second opposing side tray panels that contain the extension portions are located on opposing sides of the same tray portion.

7. The blank of claim 1, wherein one flap portion comprises a tab and its opposing flap portion comprises a slit, and wherein the tab has a size and shape configured to fit inside the slit.

8. The blank of claim 1, wherein one or more of the flap portions comprises one or more cut lines configured to form relief cuts that are configured to receive utensils when the container is assembled.

9. The blank of claim 1, wherein in the first tray portion, each of the opposing side tray panels comprises a first extension portion, wherein each first extension portion extends toward the adjacent opposing side tray panel in the second tray portion, and wherein in the second tray portion, each of the opposing side tray panels comprises a second extension portion, and wherein each second extension portion extends toward the adjacent opposing side tray panel in the first tray portion.

10. The blank of claim 9, wherein the first extension portion has a length that is equal to or approximately equal to the length of the second extension portion.

11. A leak-resistant, two-compartment container for food storage and/or transportation comprising:

a tray and four closure flaps, wherein the tray comprises a first compartment and a second compartment, wherein the first compartment is separated from the second compartment by an interior partition, wherein each of the first and second compartments has a trapezoidal shape comprising three sidewalls, a partition wall, a bottom, and four corners, and wherein a folded gusset is adjacent to each corner, wherein each closure flap is hingedly connected to the tray and foldable between an open position and a closed position, wherein in each of the first and second compartments, the three sidewalls comprise two opposing sidewalls and a third sidewall, wherein the opposing sidewalls are located on a first set of opposing sides of the bottom and the third sidewall and the partition wall are located on a second set of opposing sides of the bottom, wherein in only one compartment each opposing sidewall comprises an extension portion, and wherein an exterior surface of each extension portion adheres to an extension contacting portion of an interior surface of the adjacent opposing sidewall.

12. The container of claim 11, wherein one or more of the fold lines that connect the four flap portions to the tray portion is perforated.

13. The container of claim 11, wherein each folded gusset adheres to an interior surface one of the sidewalls.

14. A leak-resistant, two-compartment container for food storage and/or transportation comprising:

a tray and four closure flaps, wherein the tray comprises a first compartment and a second compartment, wherein the first compartment is separated from the second compartment by an interior partition, wherein each of the first and second compartments has a trapezoidal shape comprising three sidewalls, a partition wall, a bottom, and four corners, and wherein a folded gusset is adjacent to each corner, wherein each closure flap is hingedly connected to the tray and foldable between an open position and a closed position, wherein in each of the first and second compartments, the three sidewalls comprise two opposing sidewalls and a third sidewall, wherein the opposing sidewalls are located on a first set of opposing sides of the bottom and the third sidewall and the partition wall are located on a second set of opposing sides of the bottom, wherein the first closure flap is hingedly connected to the third sidewall of the first compartment via a first top edge, wherein the second closure flap is hingedly connected to the third sidewall of the second compartment via a second top edge, wherein the third closure flap is hingedly connected to the first opposing sidewall that contains a first extension portion via a first extended top edge, and wherein the fourth closure flap is hingedly connected to the second opposing sidewall that contains a second extension portion via a second extended top edge, and wherein the first and the second opposing sidewalls that contain the first and second extension portions are located on opposing sides of the same compartment.

15. The container of claim 14, wherein the length of each of the first and the second opposing sidewalls that contains an extension portion is the same as or similar to the length of the tray.

16. The container of claim 14, wherein one or more of the top edges and extended top edges are perforated to facilitate removal of the closure flaps from the tray.

17. The container of claim 14, wherein the first compartment is smaller or larger than the second compartment.

18. A leak-resistant, two-compartment container for food storage and/or transportation comprising:

a tray and four closure flaps, wherein the tray comprises a first compartment and a second compartment, wherein the first compartment is separated from the second compartment by an interior partition, wherein each of the first and second compartments has a trapezoidal shape comprising three sidewalls, a partition wall, a bottom, and four corners, and wherein a folded gusset is adjacent to each corner, wherein each closure flap is hingedly connected to the tray and foldable between an open position and a closed position, wherein the container is formed from a blank comprising:

a tray portion and four flap portions, wherein each of the four flap portions is connected to the tray portion via a fold line, wherein the tray portion comprises a first tray portion and a second tray portion, wherein the first tray portion is connected to the second tray portion via a central fold line, wherein each of the first and second tray portions includes a bottom tray panel, three side tray panels, four sets of gusset panels, and an interior partition panel, wherein each of the side tray panels and the interior partition panel is connected to one side of the bottom tray panel via a fold line, wherein in each of the first and second tray portions, the three side tray panels comprise two opposing side tray panels and a third side tray panel, wherein the opposing side tray panels are located on a first set of opposite sides of the bottom tray panel and the third side tray panel and the partition panel are located on a second set of opposite sides of the bottom tray panel, wherein each opposing side tray panel is connected to the third side tray panel via the first and the second sets of gusset panels and to the interior partition panel via the third and the fourth sets of gusset panels, wherein each set of gusset panels comprises a first gusset panel and a second gusset panel, and wherein the first gusset panel is connected to the second gusset panel via a dividing fold line, and wherein in at least one of the first tray portion and the second tray portion each of the opposing side tray panels comprises an extension portion, wherein the extension portion extends toward the adjacent opposing side tray panel.

19. The container of claim 18, wherein one or more of the fold lines that connect the four flap portions to the tray portion is perforated.

20. The container of claim 18, wherein each folded gusset adheres to an interior surface one of the sidewalls.

* * * * *